US007814956B2

(12) United States Patent
Lethers et al.

(10) Patent No.: US 7,814,956 B2
(45) Date of Patent: Oct. 19, 2010

(54) PET DOOR

(75) Inventors: E. Alan Lethers, San Luis Obispo, CA (US); Scott Ganaja, San Luis Obispo, CA (US)

(73) Assignee: Patio Pacific, Inc., San Luis Obispo, CA (US)

( * ) Notice: Subject to any disclaimer, the term of this patent is extended or adjusted under 35 U.S.C. 154(b) by 309 days.

(21) Appl. No.: 10/993,285

(22) Filed: Nov. 18, 2004

(65) Prior Publication Data

US 2006/0101738 A1 May 18, 2006

(51) Int. Cl.
*E06B 3/96* (2006.01)

(52) U.S. Cl. ..... 160/184; 292/251.5

(58) Field of Classification Search ..... 160/113, 160/115, 116, 180, 184, 275; 292/251.5; 52/204.51; 49/303, 315, 316, 472, 478.1, 49/483.1, 484.1, 489.1, 499.1, 163, 169, 49/484, 489, 313

See application file for complete search history.

(56) References Cited

U.S. PATENT DOCUMENTS 2,446,336 A * 8/1948 Mark et al. ..... 49/395
2,706,543 A 4/1955 Kammerer
3,299,596 A 1/1967 Neal
3,464,158 A 9/1969 Greene
3,654,733 A 4/1972 Blackwell
3,797,554 A * 3/1974 Johnson ..... 160/354
3,811,224 A 5/1974 Garrison
3,878,645 A 4/1975 Porter
3,932,959 A 1/1976 Jansons
3,985,174 A * 10/1976 Bricker ..... 160/180
4,020,595 A 5/1977 Duncan
4,047,331 A * 9/1977 Davlantes ..... 49/171
4,173,099 A * 11/1979 Robb ..... 49/168
4,322,913 A 4/1982 Himmer
4,408,416 A 10/1983 Davlantes (Continued)

OTHER PUBLICATIONS

Office Action from U.S. Appl. No. 11/471,185 dated Sep. 19, 2006.

(Continued)

*Primary Examiner*—Katherine W Mitchell
*Assistant Examiner*—Candace L. Bradford
(74) *Attorney, Agent, or Firm*—Thomas F. Lebens; Sinsheimer Juhnke Lebens & McIvor, LLP

(57) ABSTRACT

An apparatus comprising a first door panel; a second door panel coupled to the first door panel such that the first door panel and the second door panel form a hollow portion of a door panel assembly; and an insulating material placed within the hollow portion of the door panel assembly. An apparatus comprising a door panel assembly including a front side, a back side, a top side, a bottom side, a left side and a right side; a door frame surrounding the door panel assembly at the bottom side, the left side and the right side of the door panel, the door frame including a bottom portion, a left portion and a right portion; means for magnetically coupling the left side of the door panel assembly to the left portion of the door frame; means for magnetically coupling the right side of the door panel assembly to the right portion of the door frame; means for magnetically coupling the bottom side of the door panel assembly to the bottom portion of the door frame.

26 Claims, 18 Drawing Sheets

U.S. PATENT DOCUMENTS

| | | | | | |
|---|---|---|---|---|---|
| 4,480,407 | A | * | 11/1984 | Needham et al. | 49/168 |
| 4,651,793 | A | * | 3/1987 | Davlantes | 160/92 |
| 4,754,797 | A | | 7/1988 | Scronce | |
| 4,922,659 | A | | 5/1990 | Muccioli | |
| 5,185,954 | A | | 2/1993 | Waddle, Sr. | |
| 5,269,097 | A | | 12/1993 | Davlantes | |
| 5,287,654 | A | | 2/1994 | Davlantes | |
| 5,535,804 | A | * | 7/1996 | Guest | 160/180 |
| 5,657,592 | A | | 8/1997 | Davlantes | |
| 5,735,079 | A | | 4/1998 | Davlantes | |
| 5,782,037 | A | | 7/1998 | Davlantes | |
| 5,946,855 | A | | 9/1999 | Miconi | |
| 5,946,856 | A | * | 9/1999 | Davlantes | 49/168 |
| 5,967,215 | A | | 10/1999 | Needham et al. | |
| 6,272,793 | B1 | | 8/2001 | Davlantes | |
| 6,385,909 | B1 | | 5/2002 | Marsh et al. | |
| 6,453,847 | B2 | | 9/2002 | Brooks | |
| 6,467,219 | B1 | | 10/2002 | Gardner | |
| 6,681,524 | B1 | * | 1/2004 | Tillson | 49/169 |
| 6,691,483 | B2 | | 2/2004 | Lethers | |
| 6,725,806 | B1 | * | 4/2004 | Gribble | 119/484 |
| 7,063,123 | B2 | | 6/2006 | Lethers | |
| 7,150,244 | B2 | * | 12/2006 | Dawes | 119/484 |
| 2002/0011217 | A1 | * | 1/2002 | Brooks | 119/481 |
| 2004/0163346 | A1 | | 8/2004 | Lethers | |
| 2006/0101738 | A1 | | 5/2006 | Lethers | |

OTHER PUBLICATIONS

Office Action from U.S. Appl. No. 11/471,185 dated Aug. 7, 2007.
Notice of Allowance from U.S. Appl. No. 10/177,920 dated Oct. 3, 2003.
"U.S. Appl. No. 10/781,267", Lethers, Alan.
"U.S. Appl. No. 11/471,185", Lethers, Alan.
Notice Allowance from U.S. Appl. No. 11/471,185 dated Dec. 11, 2007.
Office Action from U.S. Appl. No. 10/781,267 dated Aug. 25, 2004.
Office Action from U.S. Appl. No. 10/781,267 dated Feb. 4, 2005.
Office Action from U.S. Appl. No. 10/781,267 dated May 19, 2005.
Notice of Allowance from U.S. Appl. No. 10/781,267 dated Dec. 2, 2005.
Supplemental Notice of Allowance from U.S. Appl. No. 10/781,267 dated Feb. 2, 2006.
Interview Summary from U.S. Appl. No. 10/781,267 dated Nov. 2, 2005.
Office Action from U.S. Appl. No. 11/471,185 dated Mar. 21, 2007.
Int'l Searching Authority, , International Search Report and Written Opinion of the International Searching Authority for PCTUS0541592 mailed Jul. 7, 2008.

* cited by examiner

PET DOOR

BACKGROUND OF THE INVENTION

1. Field of the Invention

The present invention relates to pet doors. More specifically, the present invention relates to a pet door that provides improved insulation.

2. Discussion of the Related Art

The use of pet doors has been widely used for allowing pets to travel in and out of homes on their own free will without the owner having to continually open and close a door for the pet. One such type of door is a frame and door assembly that can be inserted into a sliding glass door. Another such type of door is a frame and door assembly that can be inserted into a hole that has been cut through a standard door.

Generally, theses doors consist of a plastic, rubber or metal door that is attached to a hinge at the top and open and closed in either direction (in or out of the house). These door generally have very poor insulation, and if used in a windy area can easily blow open, allowing, for example, cold air to enter into the house. This can cause the house to become uncomfortable temperatures and can result in increased energy consumption if, for example, a heater is on for longer periods of time to keep the house at a desired temperature.

Thus, there is a need for an improved door assembly that will solve these and other problems.

SUMMARY OF THE INVENTION

The present invention advantageously addresses the needs above as well as other needs as will be shown and described below with reference to the detailed description and the figures.

In one embodiment, the invention can be characterized as an apparatus comprising a first door panel; and a second door panel coupled to the first door panel such that the first door panel and the second door panel form a hollow portion of a door panel assembly.

In another embodiment, the invention can be characterized as an apparatus comprising a door panel assembly including a front side, a back side, a top side, a bottom side, a left side and a right side; a door frame surrounding the door panel assembly at the bottom side, the left side and the right side of the door panel, the door frame including a bottom portion, a left portion and a right portion; means for magnetically coupling the left side of the door panel assembly to the left portion of the door frame; means for magnetically coupling the right side of the door panel assembly to the right portion of the door frame; means for magnetically coupling the bottom side of the door panel assembly to the bottom portion of the door frame.

In a subsequent embodiment, the invention can be characterized as a method comprising rotating a door panel assembly from an open position to closed position; coupling a bottom side of the door panel assembly to a bottom portion of a frame using a magnetic force when the door panel assembly is in the closed position; coupling a first side of the door panel assembly to a first side portion of the frame using a magnetic force; and coupling a second side of the door panel assembly to a second side portion of the frame using a magnetic force.

In yet another embodiment, the invention can include a door assembly comprising a door panel assembly including a front side, a back side, a top side, a bottom side, a left side and a right side; a door frame surrounding the door panel assembly at the bottom side, the left side and the right side of the door panel, the door frame including a bottom portion, a left portion and a right portion; and wherein the bottom portion of the door panel assembly is convex or concave; wherein the bottom portion of the door frame is concave or convex; and wherein the bottom portion of the door panel assembly is magnetically coupled to the bottom portion of the door frame when the door panel assembly is in a closed position.

BRIEF DESCRIPTION OF THE DRAWINGS

The above and other aspects, features and advantages of the present invention will be more apparent from the following more particular description thereof, presented in conjunction with the following drawings, wherein.

Figure 1:
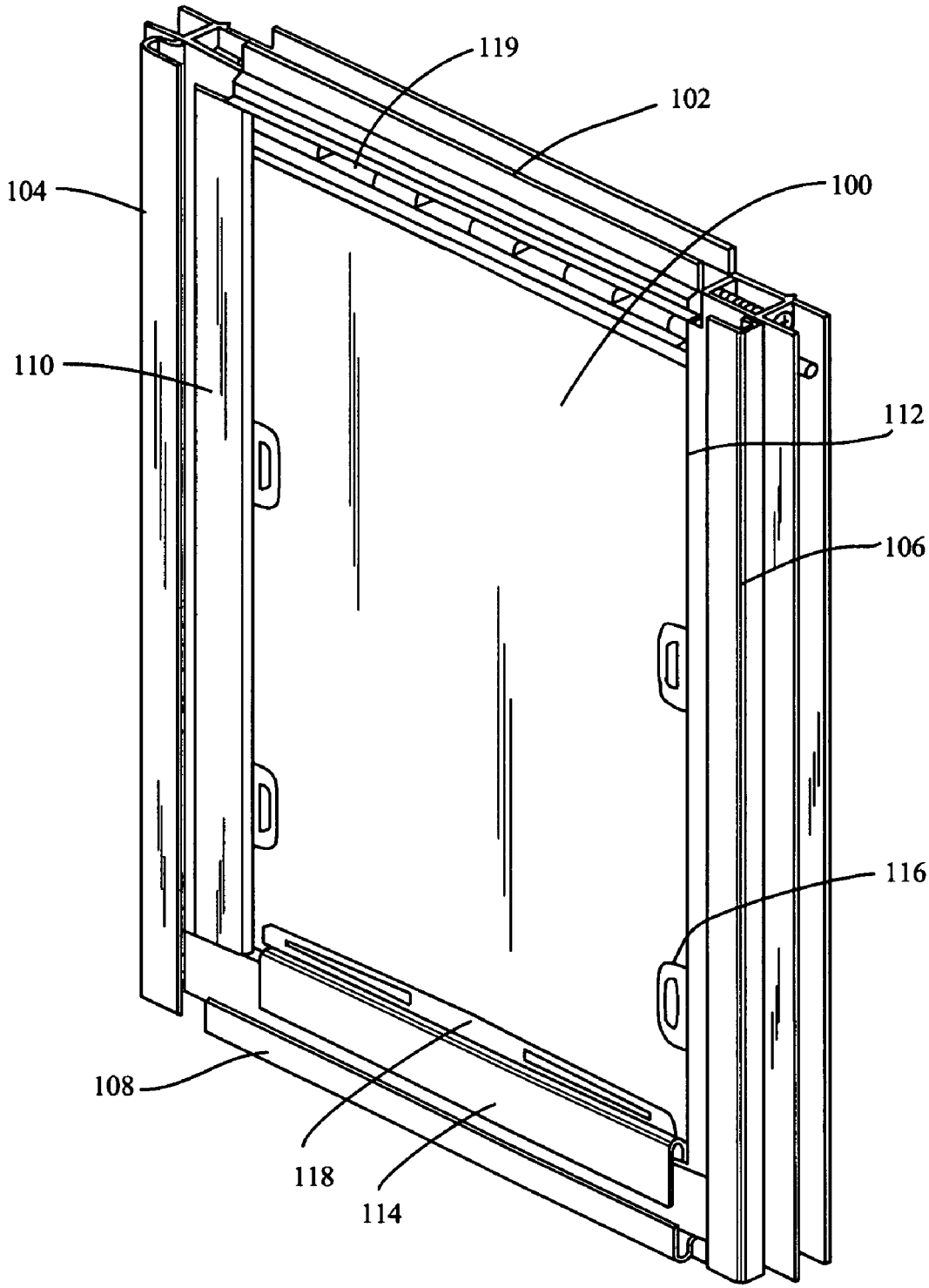
FIG. 1 is an isometric diagram illustrating a door assembly including a door panel and door frame in accordance with one embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions, sizing, and/or relative placement of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in the limiting sense, but is made merely for the purpose of describing the general principals of the invention. The scope of the invention should be determined with reference to the claims.

The door assembly described herein generally is for use with existing sliding doors in a building, e.g., a home or office. The door assembly, will be place within the existing frame of a sliding door and will generally extend from the bottom of the frame of the sliding door to the top of the frame of the sliding door. The current application is focused on the door panel and frame assembly used by the animal and located proximate the bottom of the sliding door frame and thus, the remainder of the door assembly will not be shown in order to more clearly and completely describe the present invention. It is understood by those skilled in the art that many different designs of the top portion of the door frame can be utilized with the present embodiments described herein. Additionally, features of the present embodiments can be utilized, for example, in pet doors installed into regular swinging type doors and into walls.

Referring to FIG. 1, an isometric diagram is shown illustrating a door assembly including a door panel and door frame in accordance with one embodiment. Shown is a door panel 100, a top frame 102, a first side frame 104, a second side frame 106, a bottom frame 108, a first side strike 110, a second side strike 112, a bottom strike 114, a plurality of side retainers 116, a bottom retainer 118.

The door panel 100 is located between the top frame 102, the bottom frame 108, the first side frame 104 and the second side frame 106. The top frame 102 is coupled to both the first side frame 104 and the second side frame 106, by using, for example, a fastener (e.g., a screw or bolt) such as is shown in FIG. 17. At the top of the door panel is a rod 119 (shown more clearly in FIGS. 11, 12, 15 and 16). The rod is rotatably coupled to both the first side frame 104 and the second side frame 106.

Coupled to sides of the door panel 100 are the plurality of side retainers 116. Coupled to a bottom of the door panel 100 is a bottom retainer. Located between the first side frame 104 and a left side of the door panel 100 is the first side strike 110. Located between the second side frame 106 and the door panel 100 is the second side strike 112. Located between the bottom frame 108 and the bottom of the door panel 100 is the bottom strike. In the embodiment shown, the first side strike 110 and the second side strike 112 both extend substantially the entire length between the top frame 102 and the bottom frame 108. The bottom strike 114 extends substantially the entire length of the bottom of the door panel, and optionally extends substantially the entire length between the first side frame 104 and the second side frame 106.

When the door panel is in a closed position (as shown), the left side of the door panel 100 is magnetically coupled to the first side strike 110, the right side of the door panel 100 is magnetically coupled to the second side strike 112, and the bottom of the door panel 100 is magnetically coupled to the bottom strike 114. Various embodiments for the magnetic coupling will be described throughout this document (e.g., at least with reference to FIGS. 2-10, 13 and 18-20).

In operation, the door panel and rod rotate within a bushing in the frame to provide an opening for a pet, e.g., a dog or cat. The door panel 100 can open in either direction (forward or backward) such that the pet can pass through the door in either direction. One embodiment of an open door panel will be shown and described in greater detail herein with reference to FIGS. 9 and 10. Optionally, in one embodiment, the door panel 100 is only able to open in one direction, however, preferable, as described above, the door opens in both directions. As a force (e.g., from a pet pushing on the door) is exerted against either a front side or back side (not shown) of the door panel 100, the door panel will start to move, for example, forward, causing the magnetically coupling of the door panel to the strikes (i.e., the first side strike 110, the second side strike 112, and the bottom strike 114) to disengage. After the disengagement, the bottom strike 114 will move downward toward the bottom frame 108 and each of the side strikes 110, 112 will move toward respective side frames 104, 106. In one embodiment, long thin flat leaf-type springs are used to gently urge the side strikes 110, 112 into a retracted position (i.e., toward respective side frames 104, 106). Alternatively, the side strikes 110, 112 loosely stay wherever they end up upon opening of the door panel 100 and no springs are needed.

When a force is no longer being applied to the door panel 100, for example, the pet has passed through the door assembly, the door panel 100 will move back to the closed position. When the door panel 100 is substantially back to the closed position, the magnetic coupling will reengage. At this time, the bottom strike will move upward until contacting the bottom of the door panel 100 (or the bottom retainer 118 if present). Similarly, the first side strike 110 and the second side strike 112 will move inward until contacting the left side and right side of the door panel, respectively. Advantageously, the strikes provide insulation and a wind barrier when the door panel 100 is in the closed position.

Generally, the present invention is not limited by the specific types of materials used for any parts in the construction of the door assembly. However, as will be described herein some parts will have a preferable type of construction material. Preferably a frame assembly (i.e., the top frame 102, the first side frame 104, the second side frame 106, and the bottom frame 108, in the present embodiment) is made from aluminum. In this embodiment, the frame is a lightweight and durable. Many other materials or combinations of materials are used for the frame in different embodiments, e.g., metals, metal alloys, steel, stainless steel, composites, or plastics are used in different embodiments to construct the frame assembly. As referred to herein, the first side strike 110, the second side strike 112, and the bottom strike 114 are also part of the frame assembly. The frame assembly, can be constructed with or without the strikes (i.e., the first side strike 110, the second side strike 112, and the bottom strike 114). Furthermore, as described in different embodiments herein, the strikes can optionally be fixed to the frame such that they are not movable.

The door panel is preferably made from a flexible plastic or flexible elastomer. A flexible door panel advantageously provides safety features for an animal using the door assembly. A flexible door panel will reduce the likelihood of a pet's paw or head getting pinched between the door panel and a portion of the frame assembly when the pet reverses direction midway through the pet door. Thus, the use of a flexible material reduces the likelihood of injury to the pet. Alternatively, however, is some embodiments, the door panel is constructed from a rigid plastic, stamped metal, or other rigid or flexible material.

In one embodiment, the door panel is made from two molded pieces of flexible plastic or flexible elastomer. Optionally, the two molded pieces of plastic can be identical, such that manufacturing efficiency can be improved by only having one plastic mold instead of two. The different embodiments of the door panel will be described in greater detail herein at least with reference to FIGS. 2, 4, 5, 11-12, 14-16 and 18-19.

The first side strike 110, the second side strike 112 and the bottom strike 114 (collectively referred to herein as the strikes) are preferably made from steel, iron or other magnetic material. In this embodiment, the sides of the door panel will preferably have magnets inside of the door panel, such that the side strikes 110 and 112 will be magnetically coupled to the door panel 100 when the door panel 100 is in the closed position (as shown). This embodiment is shown and described in further detail herein at least with reference to FIG. 13. Alternatively, the strike can be made from aluminum, plastic or other rigid material and have magnets attached to the strike. This embodiment will be further described herein at least with reference to FIGS. 7 and 8.

Figure 2:
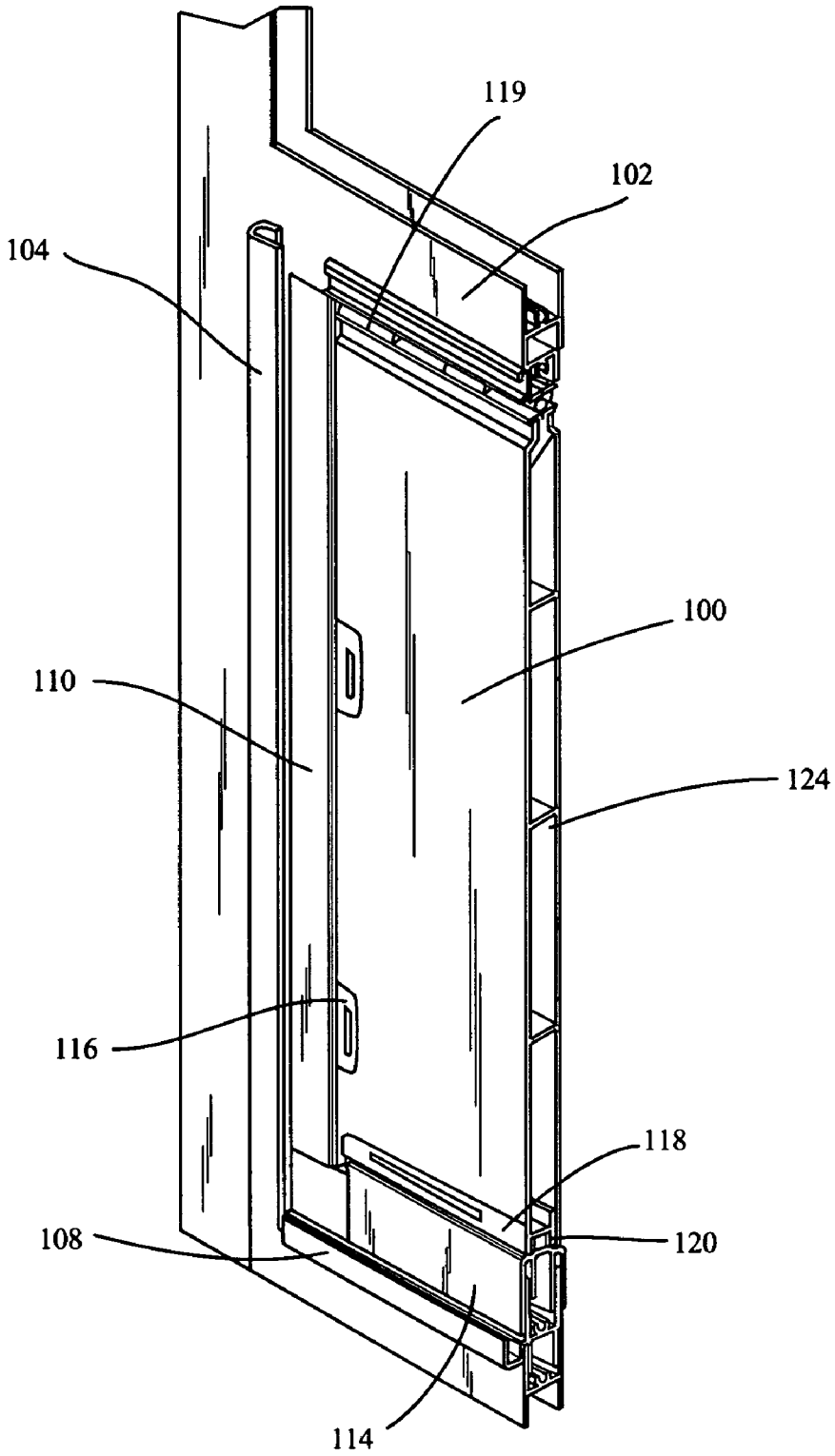
FIG. 2 is an isometric diagram illustrating half of the door assembly shown in FIG. 1 in accordance with an embodiment.

Referring to FIG. 2 an isometric diagram is shown illustrating a cross section of half of the door assembly shown in FIG. 1 in accordance with an embodiment. Shown is the door panel 100, the top frame 102, the first side frame 104, the bottom frame 108, the first side strike 110, the bottom strike 114, the plurality of side retainers 116, the bottom retainer 118, a bottom magnet 120, and a plurality of door panel dividers 124.

FIG. 2 additionally shows the bottom magnet 120, inside of the door panel and located proximate the bottom of the door panel. The bottom magnet 120 provides for the magnetic coupling between the bottom strike 114 and a bottom of the door panel 100. The bottom magnet can be rigid or flexible. Additionally, as mentioned above, the bottom strike 114 is made from steel, iron, alloy, or other magnetic material that is magnetically attracted to the bottom magnet 120. Thus, when the door is in the closed position, the bottom strike 114 will move in an upward direction until contacted the bottom of the door panel 100. Alternatively, in an embodiment of the door panel utilizing the bottom retainer 118, the bottom strike 114 will move in an upward direction until contacting the bottom retainer 118. The bottom retainer will be described herein in greater detail at least with reference to FIG. 4.

In a preferred embodiment, the door panel 100 is hollow such that the hollow area provides for a layer of insulation. Similarly, the frame assembly is generally designed such that there space for air in between a front of the frame (e.g., outside of a home) and a back of the frame (e.g., inside of a home) such that the air provides for a layer of insulation for the house.

The door panel 100, in the embodiment shown, also includes the plurality of door panel dividers 124. The plurality of door panel dividers 124 are preferably horizontal, however, can for example, be at different angles or in some embodiments can be vertical. Additionally, the door panel dividers 124 generally extend from the left side of the door to the right side of the door and isolate air from one area inside of the hollow portion of the door panel 100 to a second area inside the hollow portion of the door panel 100. However, the door panel dividers 124 need not extend the full width of the door as long as they limit air flow within the hollow portion of the door panel 100. The door panel dividers 124 reduce the circulation of air within the hollow portion of the door panel 100, thus providing more insulation as compared to a similar door panel without the door panel dividers 124.

In another embodiment, the hollow portion of the door can be completely or partially filled with an insulating material (e.g., fiberglass or foam, such as is used for insulation of homes and other buildings). The insulating material can be used with or without the door panel dividers 124.

Figure 3:
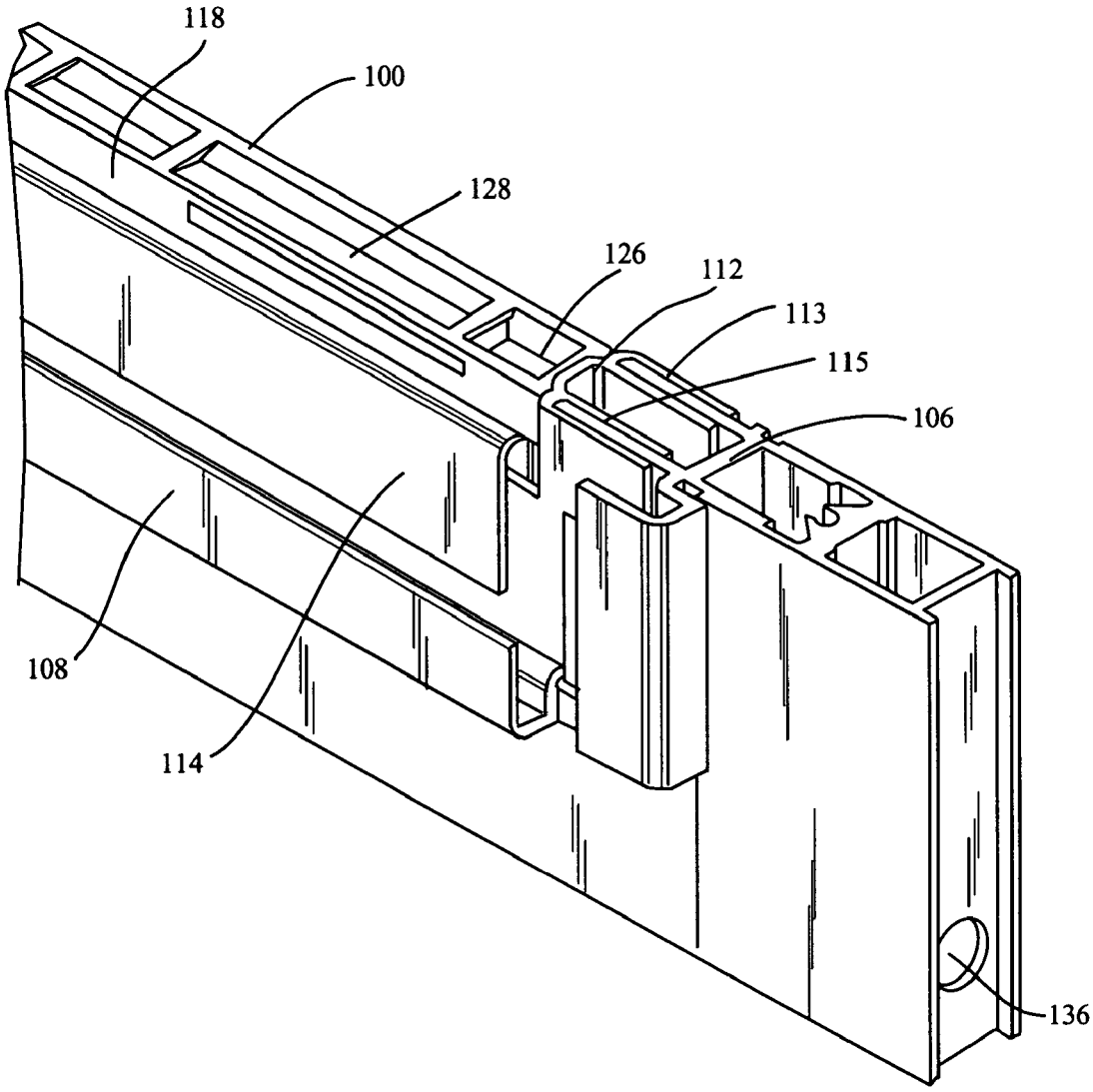
FIG. 3 is an isometric diagram illustrating a bottom of the frame shown in FIG. 1 in accordance with one embodiment.

Referring to FIG. 3 an isometric diagram is shown illustrating a cross section of a bottom of the door assembly shown in FIG. 1 in accordance with one embodiment. Shown is part of the door panel 100, the second side frame 106, the second side strike 112, a first u-shaped portion 113 of the second strike 112, a second u-shaped portion 115 of the second strike 112, the bottom frame 108, the bottom strike 114, the bottom retainer 118, a space 126 for a side magnet (not shown), and a space 128 for the bottom magnet 120 (not shown).

The second side frame 106 is moveably coupled to the second side strike 112. In a preferred embodiment, the second side strike 112 includes the first u-shaped portion 113 and the second u-shaped portion 115. The first u-shaped portion 113 and the second u-shaped portion 115 are interleaved with two portions of the second side frame 106. The door panel 100 is shown in the closed position such that the second side strike 112 and the bottom strike 114 are magnetically coupled to the door panel 100. In accordance with the present invention, many different means of fastening the side frames to the top frame 102 and the bottom frame 108 may be utilized. Additionally, the frame assembly need not be constructed from the top frame 102, the side frames 104, 106, and the bottom frame 108, but can be constructed from any number of separate or continuous parts (e.g., the frame assembly can be one continuous frame all the way around the door panel).

The bottom retainer 118 is coupled to the bottom of the door panel. The door panel 100 includes the space 128 for the bottom magnet 120 (shown in FIG. 2) and the space 126 for the side magnet (shown in FIG. 13). In an alternative embodiment, the bottom retainer 120 and/or the plurality of side retainers (or optionally part or all of the door panel 100) can be made from a magnetic material (e.g., steel, iron, or an alloy) and the first side strike 110, the second side strike 112, and/or the bottom strike 120 can include magnets, or can be coupled to magnets (such as is shown at least in FIGS. 5, 6 and 8), thus providing the magnetic coupling between the door panel 100 and the strikes 110, 112, and 114.

As described above, the first u-shaped portion 113 and the second u-shaped portion 115 of the side strike are interleaved with the second side frame 106. Advantageously, this configuration provides a side strike that is easily moveable. Additionally, the configuration provides stability for the side strike 112 as the lateral movement is limited by the contact between the second side, frame 106 and the second side strike 112. The same configuration can be utilized for both the first side strike 110 and the bottom strike 114. The shape and mechanical integration of the frame to all of the strikes is but one exemplary embodiment of the present invention. It is within the scope of the present invention that many alternative mechanical designs for the frame and the strikes may be utilized in accordance with alternative embodiments.

Figure 4:
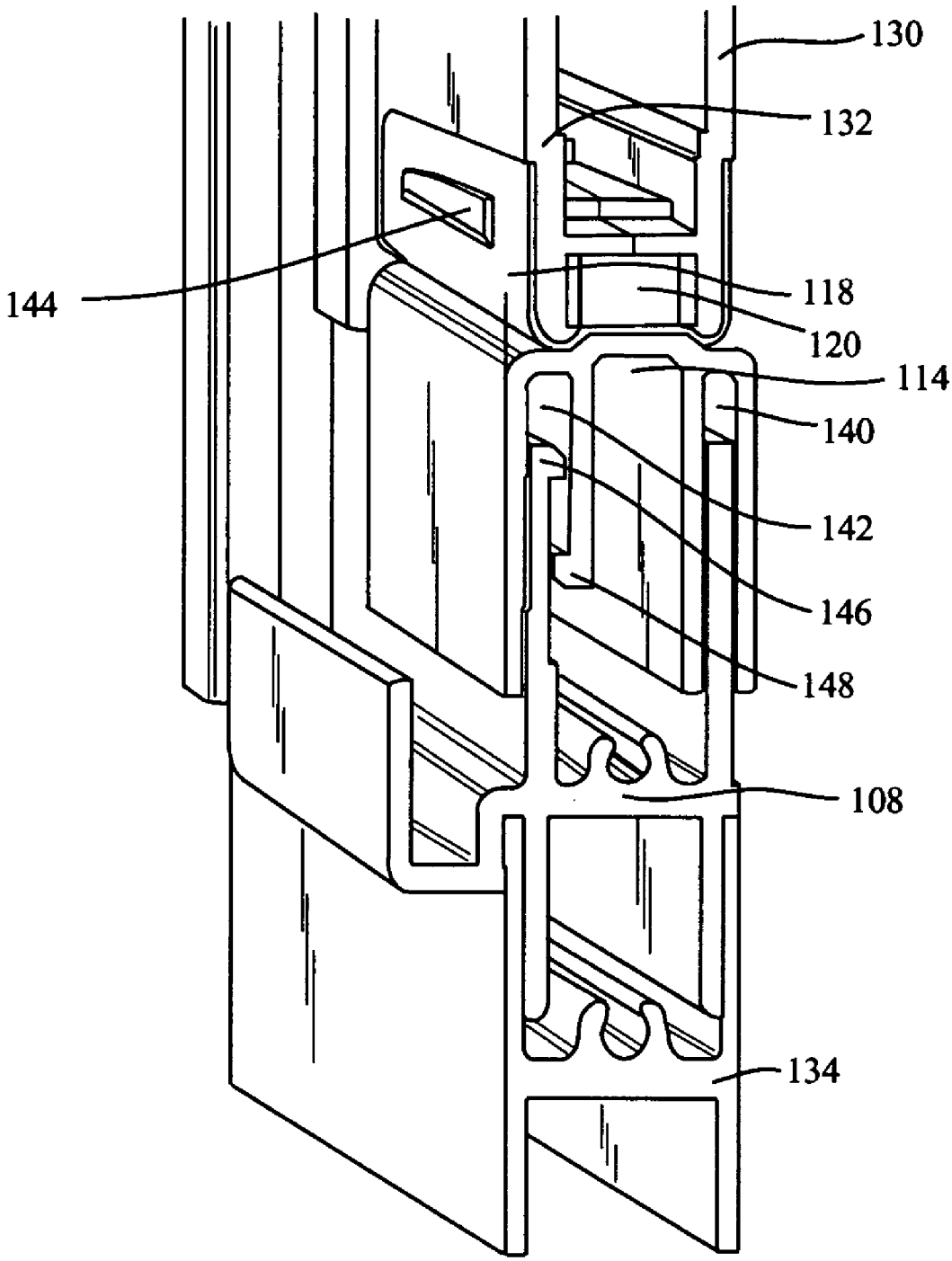
FIG. 4 is an isometric diagram illustrating a bottom of the door panel and the door frame shown in FIG. 2 in accordance with one embodiment.

Referring to FIG. 4 an isometric diagram is shown illustrating a bottom of the door and the door frame shown in FIG. 2 in accordance with one embodiment. Shown is a first portion of a door panel 130, a second portion of a door panel 132, the bottom frame 108, the bottom strike 114, the bottom extension 134, the bottom retainer 118, the bottom magnet 120, a first u-shaped 140 portion of the bottom strike 114, a second u-shaped portion 142 of the bottom strike 114, a first hook 146, a second hook 148, and a retainer tab 144.

The first portion of the door panel 130 is coupled to the second portion of the door panel 132. In one embodiment, the first portion of the door panel 130 and the second portion of the door panel 132 are identically molded pieces of flexible plastic. The first portion of the door panel 130 is coupled to the second portion of the door panel 132 are held together at an upper edge of the door panel 130 (shown and described herein at least with reference to FIGS. 14-16). The second portion of the door panel 132 includes the retainer tab 144 (the first portion of the door panel 130 also includes a retainer tab) that the bottom retainer 118 clips onto. The bottom retainer 118 holds the first portion of the door panel 130 and the second portion of the door panel 132 together at the bottom. Similarly, the first portion of door panel 130 and the second portion of the door panel 132 can include retainer tabs on the sides such that the side retainers (shown in FIGS. 1 and 2) hold the sides of the first portion of the door panel 130 and the second portion of the door panel 132 together.

In the embodiment shown, the bottom magnet 120 is located between the first portion of the door panel 130 and the second portion of the door panel 132 and is held in place by the bottom retainer 118. Alternatively, in embodiments where the bottom retainer 118 is not utilized, the bottom magnet 120 can be held in place by the structure of the door panel. It should be understood that many different configurations of securing the bottom magnet 120 proximate the bottom of the door panel may be utilized without deviating from the scope of the present invention.

The bottom strike 114 is optionally formed with the first u-shaped portion 140 and the second u-shaped portion 142. Similarly to the side strike described above with reference to FIG. 3, the u-shaped configuration provides for the bottom strike 114 to be moveably coupled to the bottom frame 108 while still providing stability for the bottom strike 114. Additionally, in a preferred embodiment, the bottom strike 114 includes the second hook 146 and the bottom frame 108 includes the first hook 148 such that the bottom strike is not removable when the door panel is in an open position. A similar design can also be incorporated into the side strike 112 and side frame 106 shown in FIG. 3.

The bottom strike 114 additionally includes, in one embodiment, a slightly protruding portion nearest the door panel. Additionally, the bottom retainer 118 includes, in one embodiment, a slightly intruding portion. This helps to return the door panel to center when traveling from an open position to a closed position. Advantageously, when the door panel is aligned in the center position, a better wind barrier is provided as compared to if the door panel were to return to a position that is off center. Additionally, this design helps to provide a smooth release when, for example, a pet puts a force on either side of the door panel to attempt to open or move through the door assembly. Preferably, a similar design can be utilized for the sides of the door panel and the side strikes.

Figure 5:
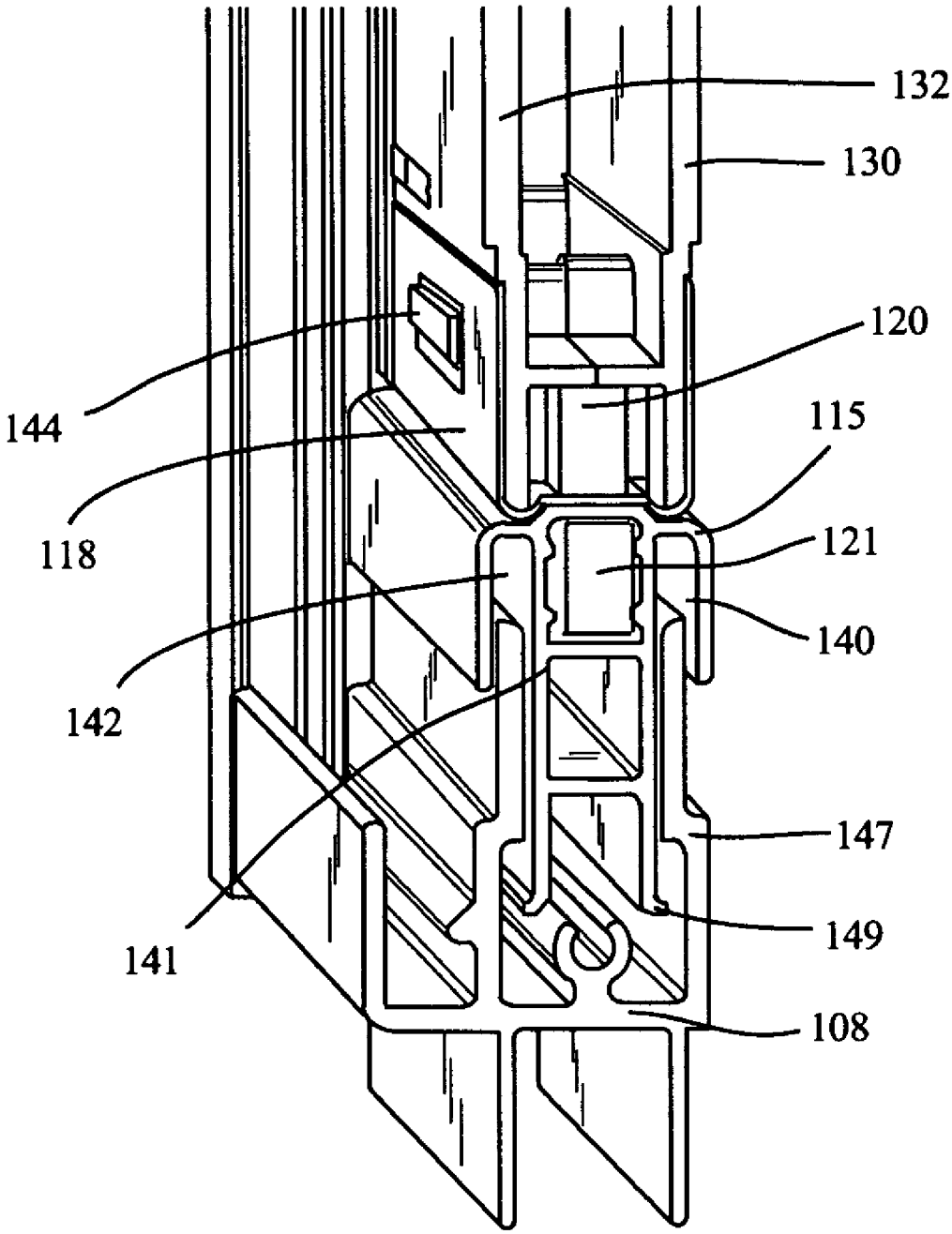
FIG. 5 is an isometric diagram illustrating a bottom of a door panel and a door frame in accordance with an alternative embodiment.

Referring to FIG. 5 an isometric diagram is shown illustrating a bottom of a door panel and a door frame in accordance with an alternative embodiment. Shown is the first portion of the door panel 130, the second portion of a door panel 132, the bottom frame 108, a bottom strike 115, the bottom retainer 118, the bottom magnet 120, a bottom strike magnet 121, the first u-shaped 140 portion of the bottom strike 115, the second u-shaped portion 142 of the bottom strike 115, a support portion 141 of the bottom strike 115, a bottom portion 149 of the bottom strike 115, the retainer tab 144, and a bottom frame portion 147.

Figure 6:
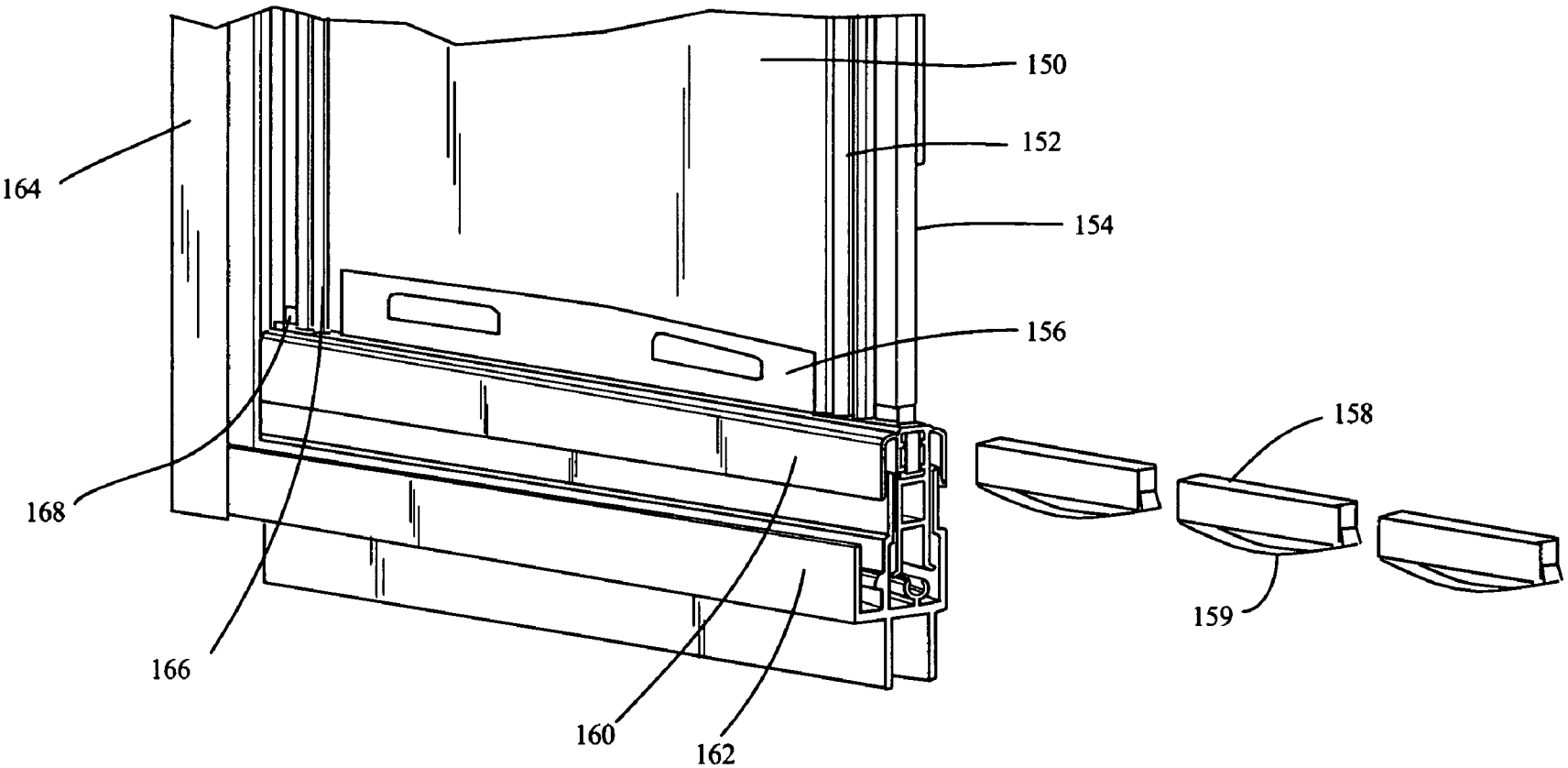
FIG. 6 is an isometric diagram illustrating part of a door panel and a door frame in accordance with another embodiment.

The bottom strike 115 shown is an alternative embodiment of the bottom strike shown in FIG. 4. The bottom strike includes the first u-shaped portion 140, the second u-shaped portion 142, the support portion 141, and the bottom portion 149. The support portion 141 provides a cavity for the bottom strike magnet 121. As is shown in FIG. 6, the bottom strike magnet 121 includes, in one embodiment, a spring portion such that the bottom strike magnet 121 is securely held within the cavity of the bottom strike 115. While only one bottom strike magnet 121 is shown, one or more magnets can be placed inside the cavity of the bottom strike 115.

The bottom portion 149 of the bottom strike 115 curves in an outward direction such that the bottom strike 115 is difficult to remove from the bottom frame 108 when the door panel is in an open position. If an attempt to remove the bottom strike 115 is made the bottom portion 149 will catch on the bottom frame 108 and will resist further upward movement of the bottom strike 115. This is an optional feature of the bottom strike 115.

Referring to FIG. 6 an isometric diagram is shown illustrating a partial door and door frame in accordance with another embodiment. Shown is part of a door panel 150, a side frame 164, a bottom frame 162, a first convolution 152, a first side magnet 154, a second convolution 166, a second side magnet 168, a bottom strike 160, a bottom retainer 156, a plurality of bottom magnets 158, and a plurality of spring clips 159.

The door panel 150 is coupled to the first convolution 152 and the second convolution 166. The first convolution 152 and the second convolution 166 are coupled to the first side magnet 154 and the second side magnet 168, respectively. The side convolutions and side magnets will be described in greater detail at least with reference to FIGS. 7 and 8. The bottom retainer 156 is also coupled to the door panel 150. The door panel 150 is shown in a closed position and is magnetically coupled to the bottom strike 160. The bottom strike is movably coupled to the bottom frame 162, for example, as described above with reference to FIG. 4. The bottom frame 162 is coupled to the side frame 164. In the embodiment shown, there is no side strike (such as shown in FIGS. 1-3) however, in one embodiment, the side strike can be included and used in combination with the side convolutions 154, 168.

The bottom strike 160 includes a hollow area for receiving the plurality of magnets 158. The plurality of magnets 158 are individually coupled to one of the plurality of string clips 159. The spring clips 159 and the hollow area of the bottom strike 160 are designed such that the magnets are easily slid into the bottom strike and still are held snug within the bottom strike. This design provides for an easy way to change the number of magnets within the bottom strike 160. Advantageously, a greater or less number of magnets is desirable for different uses of the door assembly in different conditions. For example, a small dog or a dog being trained on the door assembly may have less magnets such that less force on the door panel 150 will be required to cause the magnetic coupling to release, thus allowing the door panel to swing open. In another example, for a home located in a very windy area, more magnets can be used in order to more securely hold the door panel in place while in the closed position. This prevents the door panel from swinging open due to the wind, instead of a pet attempting to pass through the door assembly.

Figure 7:
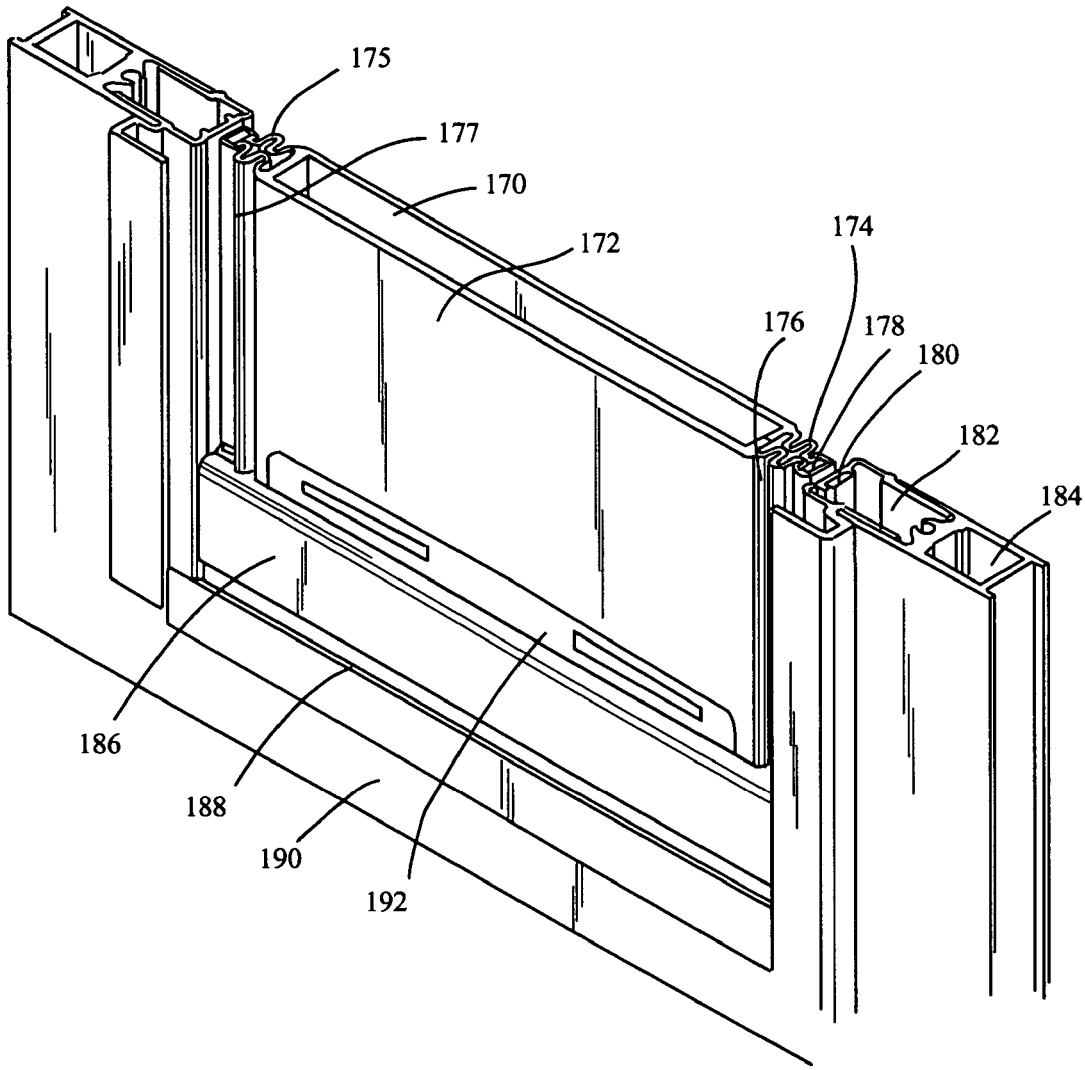
FIG. 7 is an isometric diagram illustrating a bottom portion of a door panel and door frame in accordance with one embodiment.

Referring to FIG. 7 an isometric diagram is shown illustrating a bottom portion of a door and door frame in accordance with one embodiment. Shown is part of a rear door panel 170, part of a front door panel 172, a side frame 184, a side strike 182, a bottom frame 188, a first rear portion of a side convolution 174, a second rear portion of a side convolution 175, a first front portion of a side convolution 176, a second front portion of a side convolution 177, a panel side magnet 178, a side strike magnet 180, a bottom strike 186, a bottom extension 190, and a bottom retainer 192.

The rear door panel 170 and the front door panel 172 (referred to herein as a door panel assembly) are coupled together make the door panel assembly. The first rear portion of a side convolution 174 and the second rear portion of the side convolution 175 are coupled to the rear door panel 170. The first front portion of a side convolution 176 and the second front portion of the side convolution 177 are coupled to the front door panel 172. The first rear portion of the side convolution 174 and the first front portion of the side convolution 176 are coupled together by a magnet clip (shown in FIG. 8). The magnet clip also secures the side magnet 178 to the first rear portion of the side convolution 174 and the first front portion of the side convolution 176 (collectively referred to as a side convolution assembly). This configuration is more clearly described below with reference to FIG. 8.

In the present embodiment, the side strike 182 is integral to the door panel assembly, and is not movable (such as, for example, the side strike shown in FIG. 3). The side frame 184 is part of a larger panel assembly frame that holds the door panel and door panel frame within a wall, sliding glass door, or swinging door. For example, the side frame 184 is part of a frame of the larger panel assembly which holds the glass of a sliding door when the panel assembly in used with a sliding glass door. In this embodiment, the pet door including its frame (e.g., as shown in FIG. 1) is inserted into and held in place by the side frame 184. As shown, the side strike 182 has a side strike magnet 180 attached an inner surface. Alternatively, the side strike 182 is made from iron, steel, an alloy, or other magnetic material, such that the side convolution assembly is magnetically attracted to the side strike when the door panel assembly is in a closed position. The operation of the side convolution assembly will be further described below with reference to FIG. 8.

The bottom strike 186 is moveably coupled to the bottom frame 188. This configuration functions the same as any of the bottom strikes described above with reference to FIGS. 1-6.

Figure 8:
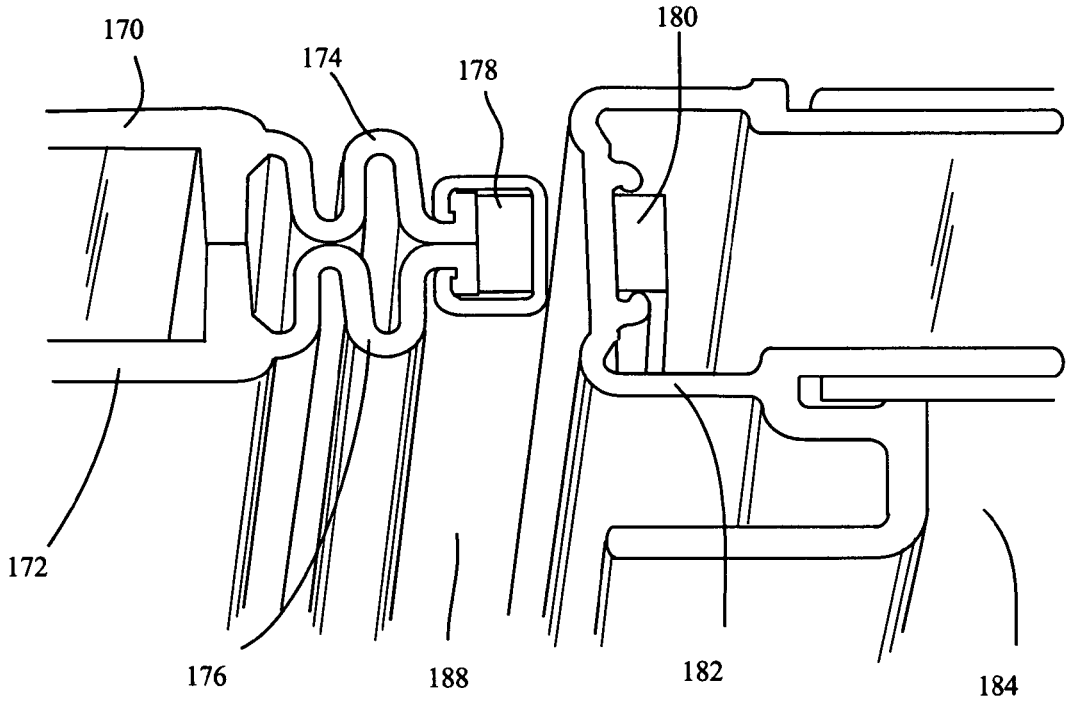
FIG. 8 is an isometric diagram illustrating a top view of a convolution and door frame shown in FIG. 7 in accordance with an embodiment.

Referring to FIG. 8 an isometric diagram is shown illustrating a top view of the side convolution and the door frame shown in FIG. 7 in accordance with one embodiment. Shown is part of the rear door panel 170, part of the front door panel 172, the side frame 184, the side strike 182, the rear portion of the side convolution 174, the front portion of the side convolution 176, the panel side magnet 178, the side strike magnet 180, and a magnet clip 188.

The rear door panel 170 is coupled to the rear portion of the side convolution 174. The front door panel 172 is coupled to the front portion of the side convolution 176. The convolution assembly (i.e., the rear portion of the side convolution 174 and the front portion of the side convolution 176) is connected together at the end proximate the side strike 182 with the magnet clip 188. The magnet clip 188 also secures the side magnet 178 to the convolution assembly. The magnet clip 188 can be made from, for example, plastic, magnetic material, or metal. The side magnet 178 and the side strike magnet 180 can be either a rigid or flexible magnet.

The rear portion of the side convolution 174 and the front portion of the side convolution 176 are both generally sinusoidal in shape. Alternate shapes may be used that allow for expansion and retraction of the convolution assembly. Additionally, the rear portion of the side convolution 174 and the front portion of the side convolution 176 are made from, for example rubber, flexible plastic or an elastomer. This allows the convolution assembly to expand when the door panel assembly is closed and contract when the door panel assembly is open. When the door panel assembly is closed, the magnetic force between the side magnet 178 and the side strike magnet 180 causes the convolution to expand, thus sealing the side of the door panel assembly to the side strike and substantially preventing air from passing through the door assembly. When the door opens, the convolution assembly retracts, thus allowing for a fluid motion of the door panel assembly, as there is no friction between the side of the door panel assembly and the side strike 182.

The side strike 182 has a slight concavity that allows the side magnet 178 to "snap" into position after overcoming the larger separation due to the raised lip of the side strike 182. This self-centering "snap" action is also used in the bottom strike 115 (shown in FIG. 5), except that the bottom strike 115 is convex and the bottom clip 118 is concave. The bottom strike 115 is convex in order to prevent water from collecting on the bottom strike 115. Additionally, the convex/concave shape of the bottom strike 115 and the side strike 182 also eliminate small line-of-sight gaps. In an alternative embodiment, the side strike 182 is convex and the side of the door panel is concave. Additionally, while not preferred, the bottom strike 115 may be concave and the bottom of the door panel convex, for example, for use in environments where water collection on the bottom strike 115 is not a concern. Advantageously, the design of the strikes and sides/bottom of the door panel helps to center the door when in the closed position.

Alternatively to the embodiment described above, the convolution assembly can be attached to the side strike and expand towards a door panel similar to the door panel shown in FIG. 1. In another optional embodiment, the bottom of the door assembly is also attached to a convolution assembly or the bottom strike is attached to the convolution assembly. This provides an alternate means for magnetically coupling the bottom of the door panel to the bottom strike or bottom frame (shown in FIG. 7).

Figure 9:
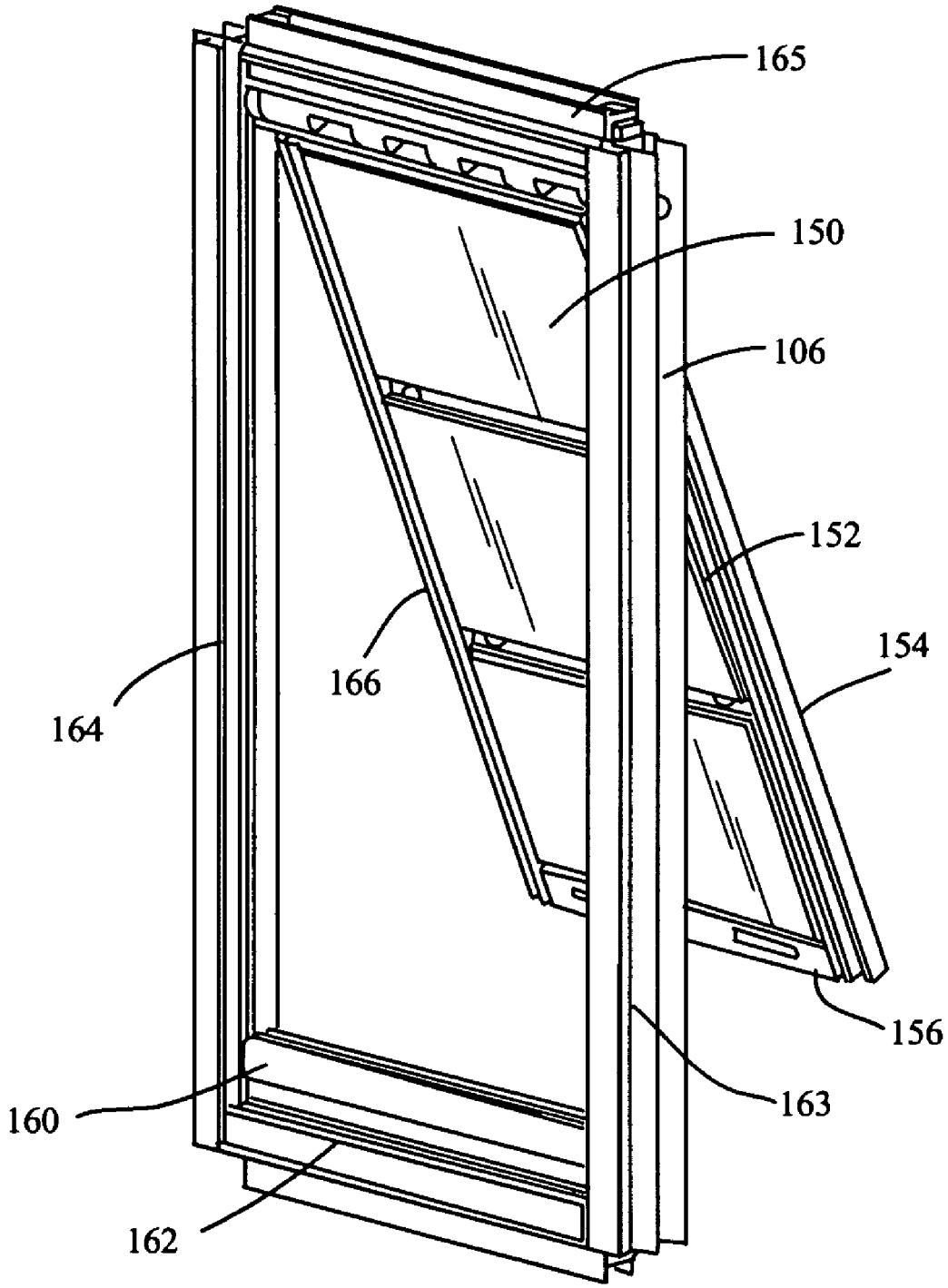
FIG. 9 is an isometric diagram illustrating a door panel assembly in a first open position in accordance with one embodiment.

Referring to FIG. 9 an isometric diagram is shown illustrating a door panel assembly in a first open position in accordance with one embodiment. Shown is the door panel 150, the first side frame 164, a second side frame 163, the bottom frame 162, a top frame 165, the first convolution 152, the second convolution 166 the first side magnet 154, the bottom strike 160, and the bottom retainer 156.

As shown, the door panel 150 is open in a backward position. When open in the backward position, the bottom strike 160 is in a retracted position as compared to when the door panel 150 is in a closed position. Additionally, the first convolution 152 and the second convolution 166 are in a retracted position as compared to when the door panel 150 is in the closed position.

Figure 10:
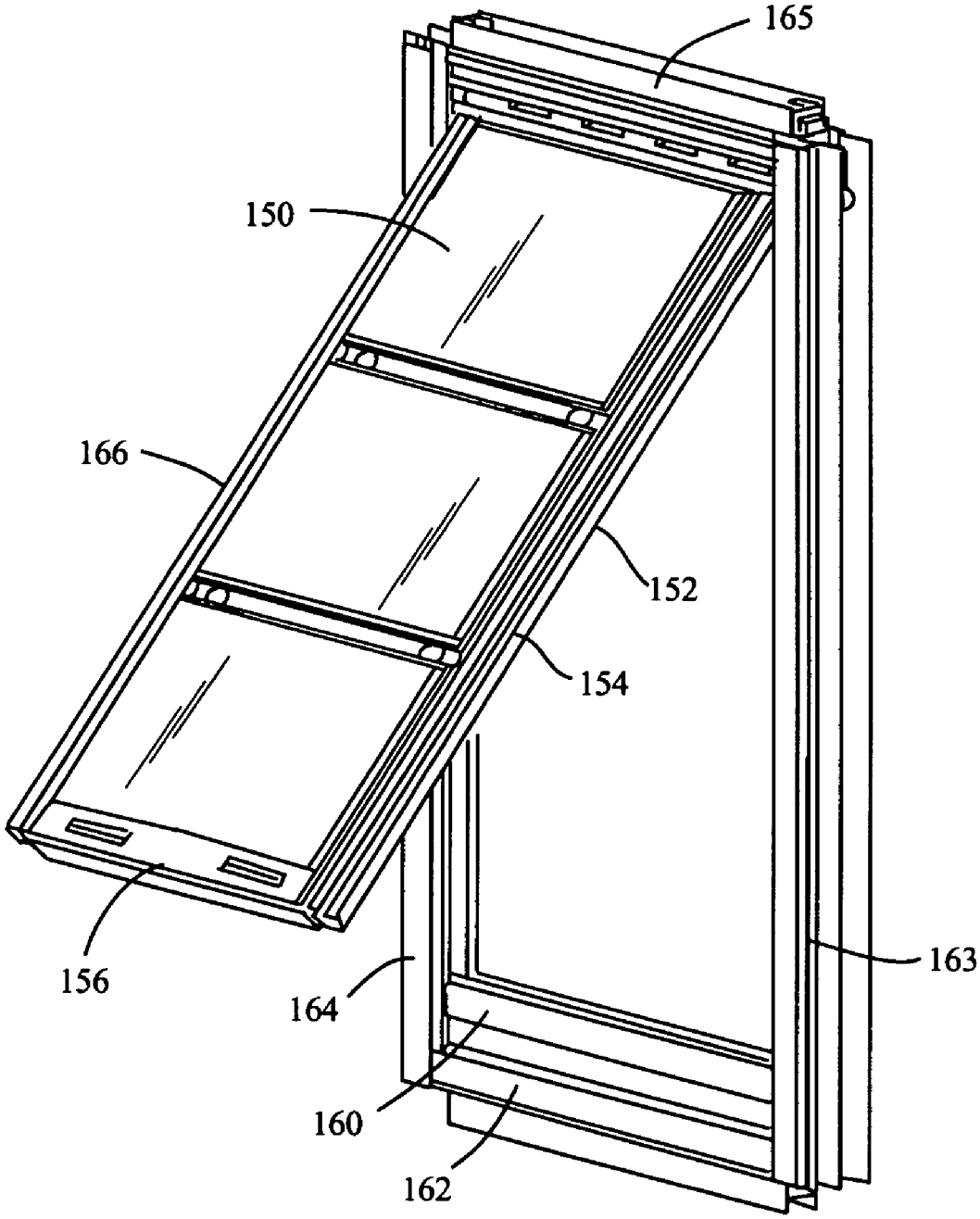
FIG. 10 is an isometric diagram illustrating the door panel assembly of FIG. 9 in a second open position in accordance one embodiment.

Referring to FIG. 10 an isometric diagram is shown illustrating the door panel assembly of FIG. 9 in a second open position in accordance one embodiment. Shown is the door panel 150, the first side frame 164, the second side frame 163, the bottom frame 162, the top frame 165, the first convolution 152, the second convolution 166, the first side magnet 154, the bottom strike 160, and the bottom retainer 156.

As shown, the door panel 150 is open in a forward position. When open in the forward position, the bottom strike 160 is in a retracted position as compared to when the door panel 150 is in a closed position. Additionally, the first convolution 152 and the second convolution 166 are in a retracted position as compared to when the door panel 150 is in the closed position.

Figure 11:
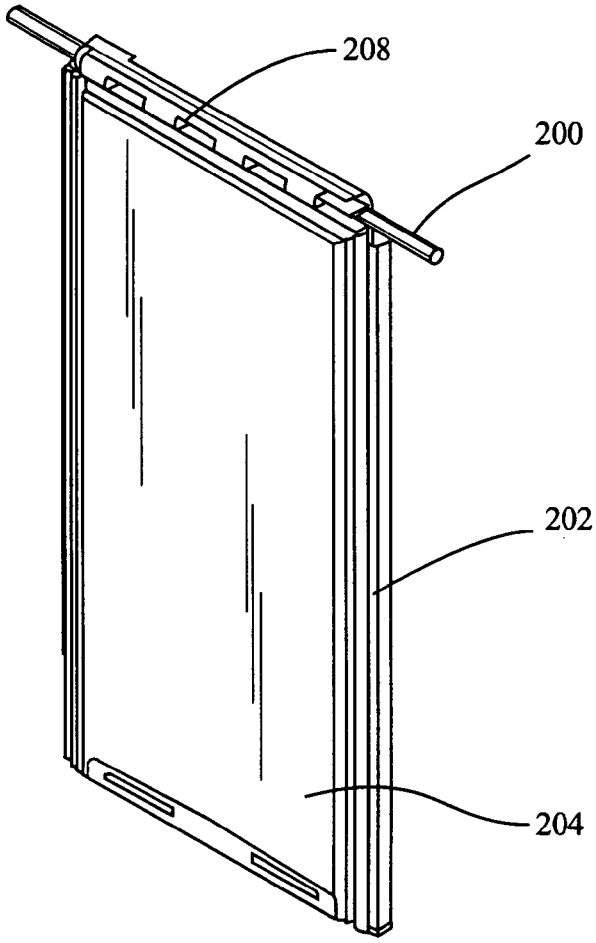
FIG. 11 is an isometric diagram illustrating a door panel in accordance with yet another embodiment.
Figure 12:
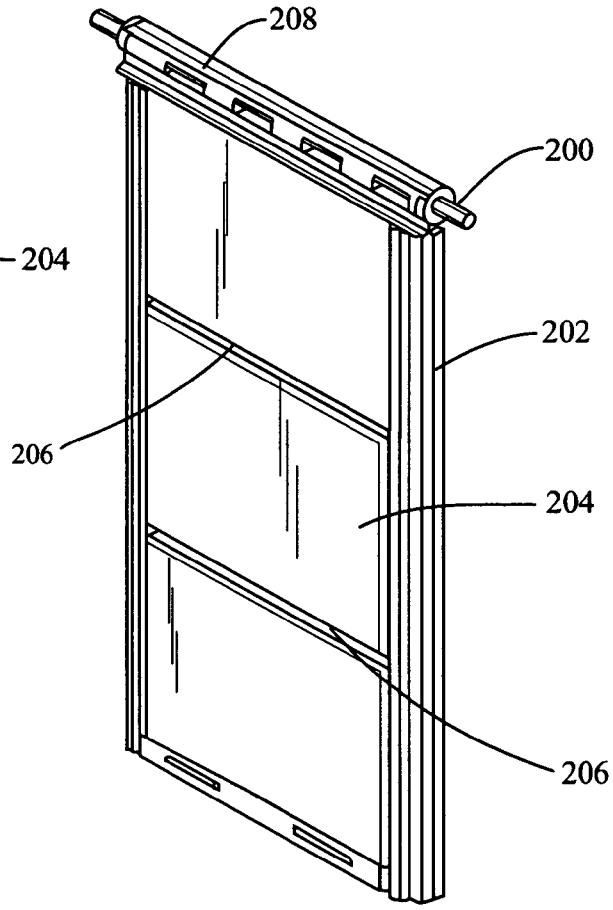
FIG. 12 is an isometric diagram illustrating a door panel in accordance with an alternative embodiment.

Referring to FIG. 11 an isometric diagram is shown illustrating a door panel in accordance with yet another embodiment. Shown is a rod 200, a convolution assembly 202, a door panel 204, and an upper edge 208 of the door panel 204. FIG. 12 shows an isometric diagram illustrating a door panel in accordance with an alternative embodiment. Shown is the rod 200, the convolution 202, the door panel 204, a plurality of dividers 206, and an upper edge 208 of the door panel 208.

The door panel 204 is coupled to the convolution assembly (such as shown above in FIG. 8). The door panel also includes the upper edge 208 that is coupled to the rod 200. The rod 200 extends through the frame (such as is show below in FIG. 17). This allows for the door panel 204 to rotate as the rod 200 rotates and thus open and close when a force is placed on either a front or back side of the door panel 204, for example, by a pet. Preferably, the door panel 204 is made from a flexible plastic or flexible elastomer. This allows the door panel 204 to flex, providing a safety feature for a pet using the door assembly.

In one embodiment, as is shown in FIG. 12, the door panel 204 includes plurality of dividers 206. The plurality of dividers 206 provide for the door panel 204 to further flex, as the door panel 204 can bend along the dividers 206. Optionally, the convolutions can also be used with a non flexible material for the areas between the convolutions. The dividers 206 additionally separate the door panel into multiple hollow portions. This feature (i.e., the dividers 206) prevent air flow within the door panel, leading to improved insulation.

Figure 13:
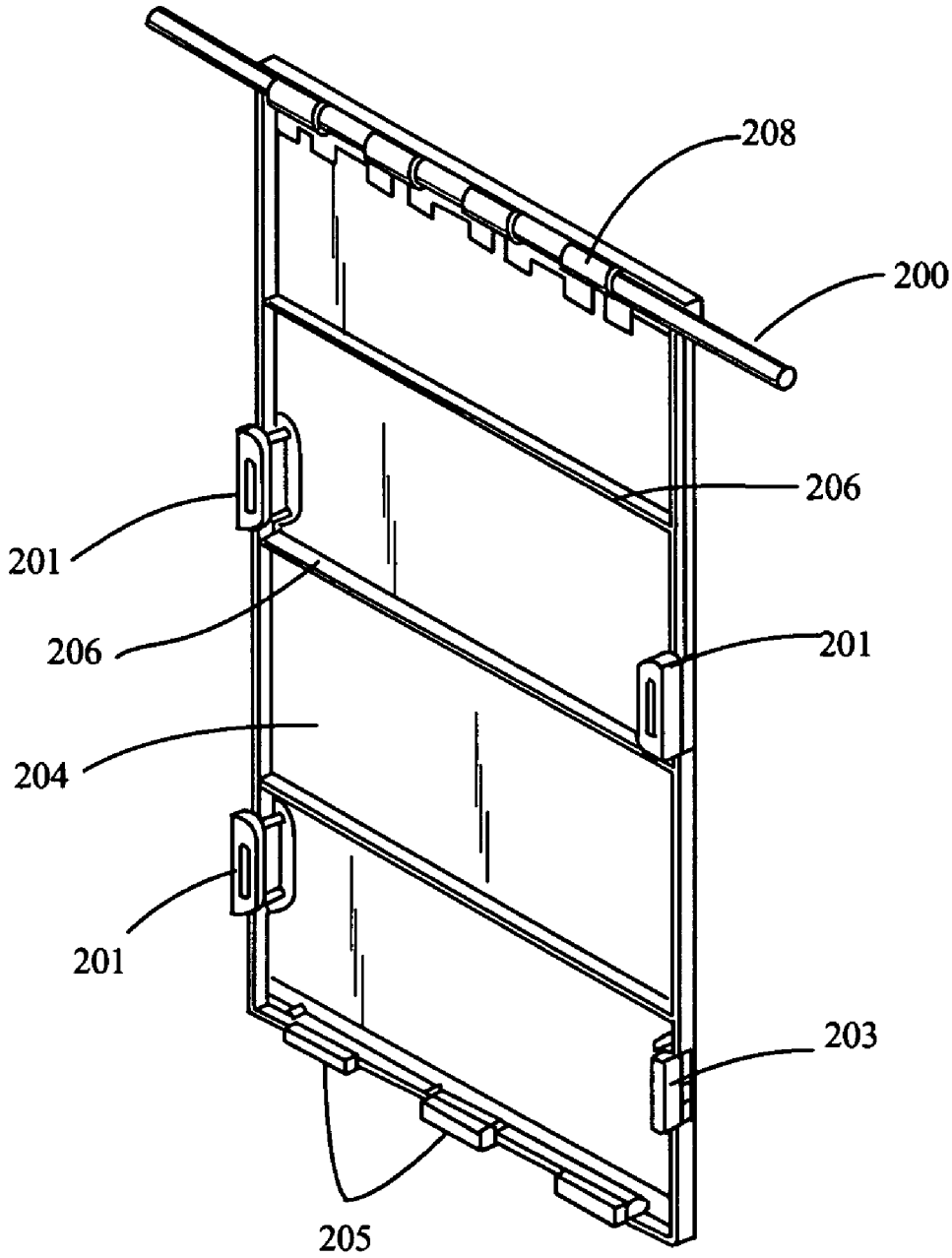
FIG. 13 is an isometric diagram illustrating half of a door panel in accordance with yet another alternative embodiment.

Referring to FIG. 13 an isometric diagram is shown illustrating a rear half of a door panel in accordance with yet another alternative embodiment. Shown is the rod 200, a rear section of the door panel 204, and the upper edge 208 of the door panel 204, a plurality of convolutions 206, a plurality of clips 201, a side magnet 203, and a plurality of bottom magnets 205.

The rod 200 is coupled to the upper edge 208 of the door panel 204. As shown, a front half of the door panel 204 has been removed for illustrative purposes, however, in operation, the plurality of bottom magnets 205 and the side magnet 203 are contained within the rear half of the door panel and the front half of the door panel (for example, such as is shown in FIG. 4).

Preferably, additional side magnets are located beneath each of the plurality of clips 201. Additionally, the side magnet 203 is shown with a removed clip for illustrative purposes. In an alternative embodiment, the side magnets are located anywhere along the side of the door panel 204. Furthermore, one or more side magnets can be located on each side. As is shown, two side magnets are shown on each side of the door panel.

In the embodiment shown, there plurality of bottom magnets 205 includes three bottom magnets. Alternatively, one or more side magnets can be located along the bottom of the door panel 204.

Figure 14:
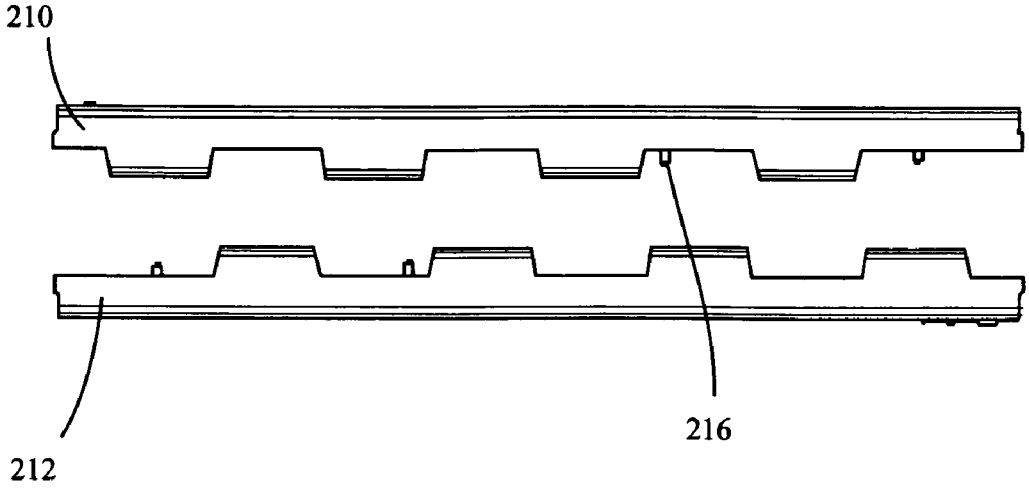
FIG. 14 is a top cross sectional view of the a separated door panel in accordance with one embodiment of either of the door panels illustrated in FIGS. 11 and 12.

FIG. 14 is a top cross sectional view of the a separated door panel in accordance with one embodiment of either of the door panels illustrated in FIGS. 11 and 12. Shown is a back panel 210, a front panel 212, and a peg 216.

The front panel 212 and the back panel 210 comprise a door panel assembly. As is shown, the front panel 212 and the back panel 210 are two identically shaped parts that are designed to clip together. The peg 216 snaps into a corresponding hole (not shown) in the opposite panel to help hold the door assembly together. Advantageously, by having two identical panels (i.e., the front panel 212 and the back panel 210) only one mold needs to be used during the manufacturing process. This is beneficial when making smaller manufacturing runs. Alternatively, in other embodiments differently shaped panels may be utilized without deviating from the scope of the present invention.

Figure 15:
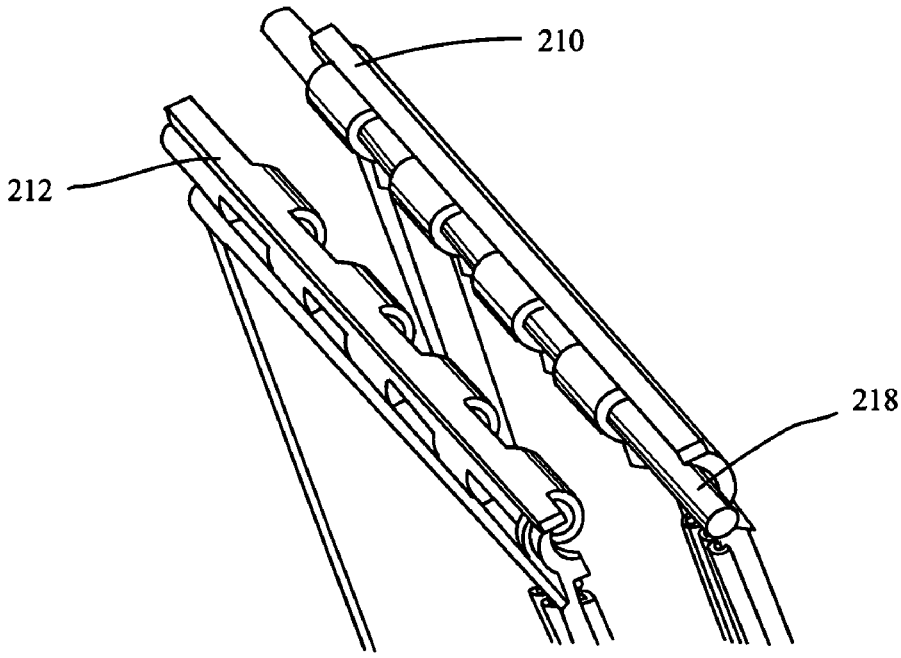
FIG. 15 is an isometric diagram illustrating part of the door panel shown in either of FIGS. 11 and 12 in accordance with one embodiment.

Referring now to FIG. 15 an isometric diagram is shown illustrating part of the door panel shown in either of FIGS. 11 and 12 in accordance with one embodiment. Shown is the back panel 210, the front panel 212, and a rod 218.

The door panel assembly (i.e., the back panel 210 and the front panel 212) is shown separated for illustrative purposes only. In operation, the rod 218 is placed through a portion of both the back panel 210 and the front panel 212. The rod 218 allows for the door panel to rotate within the frame assembly (not shown). In one embodiment, the rod 218 is rotatably coupled to the frame assembly. When a force is place upon the door panel assembly, the rod 218 will rotate with the door panel allowing the door panel assembly to open.

Figure 16:
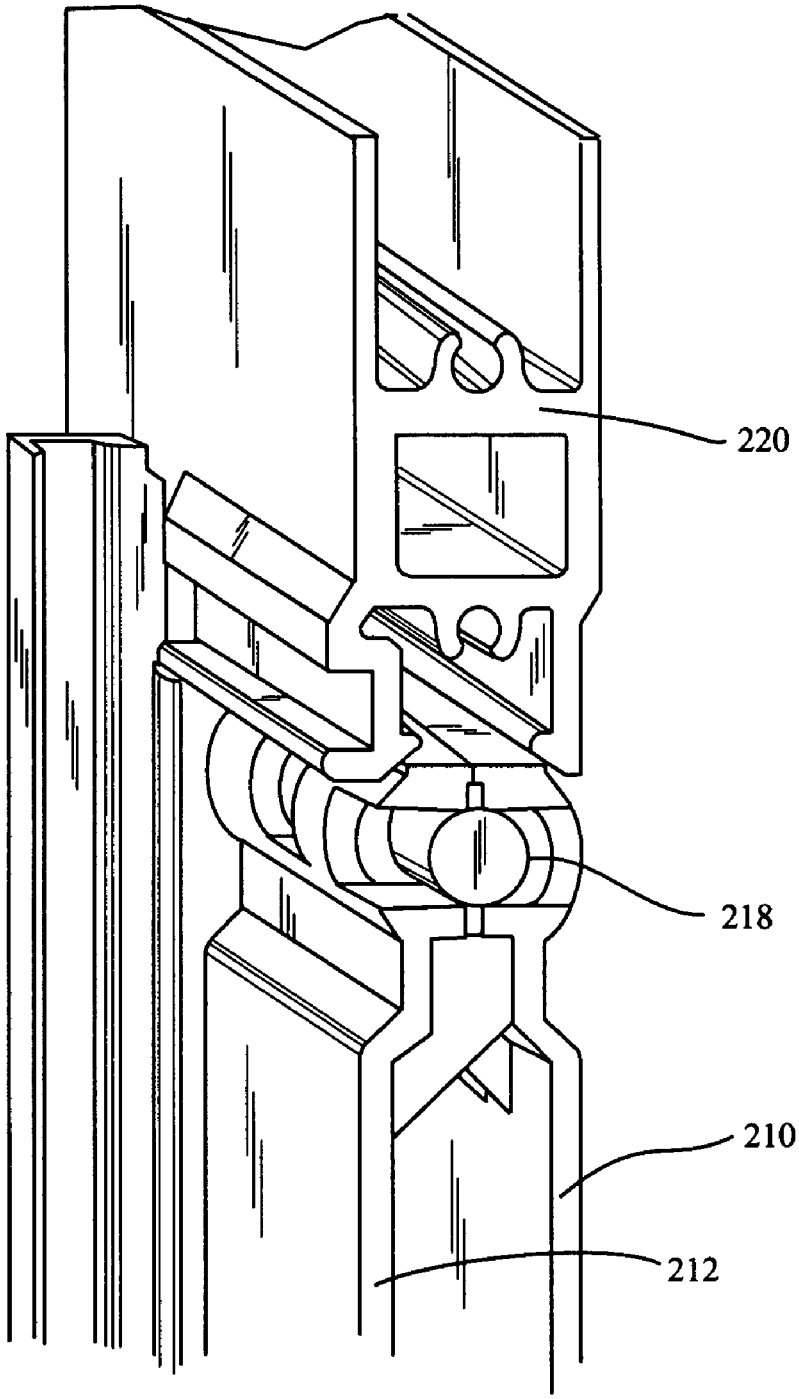
FIG. 16 is an isometric diagram illustrating part of a door and door frame in accordance with a preferred embodiment.
Figure 17:
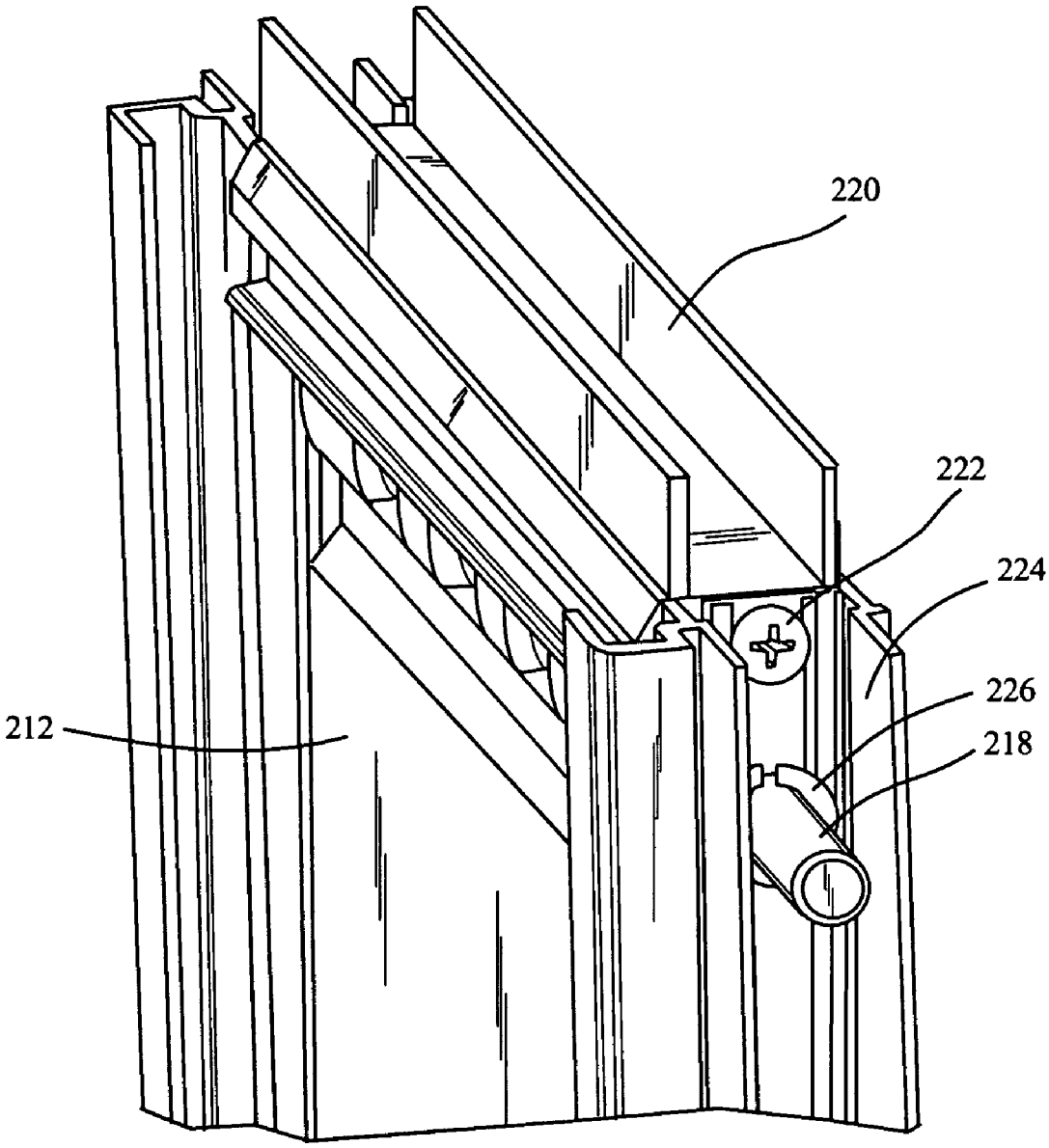
FIG. 17 is an isometric diagram illustrating part of a door and door frame in accordance with another embodiment.

FIG. 16 is an isometric diagram illustrating part of a door and door frame in accordance with a preferred embodiment. Shown is the back panel 210, the front panel 212 the rod 218, and a top frame 220.

As is shown, there is either a very small gap (or alternatively no gap) between the back panel 210, the front panel 212 and the top frame 220. This reduces or prevents airflow from traveling through the door assembly, for example, from outside to inside of a home.

FIG. 17 is an isometric diagram illustrating part of a door and door frame in accordance with another embodiment. Shown is the front panel 212, the rod 218, the top frame 220, a fastener 222, a side frame 224, and a bearing 226.

The fastener 222 attaches the side frame 224 to the top frame 220. As is shown, the fastener is a screw, however, many means for fastening the top frame 220 to the side frame 224 are utilized in different embodiments.

The rod 218 travels through the bearing 226 and the side frame 224. The bearing provides a smooth rotational movement of the door panel 212 and prevents wear on the rod 218 and frame 224. Preferably, the bearing 226 is made from a hard plastic, although other materials are used in different embodiments.

Figure 18:
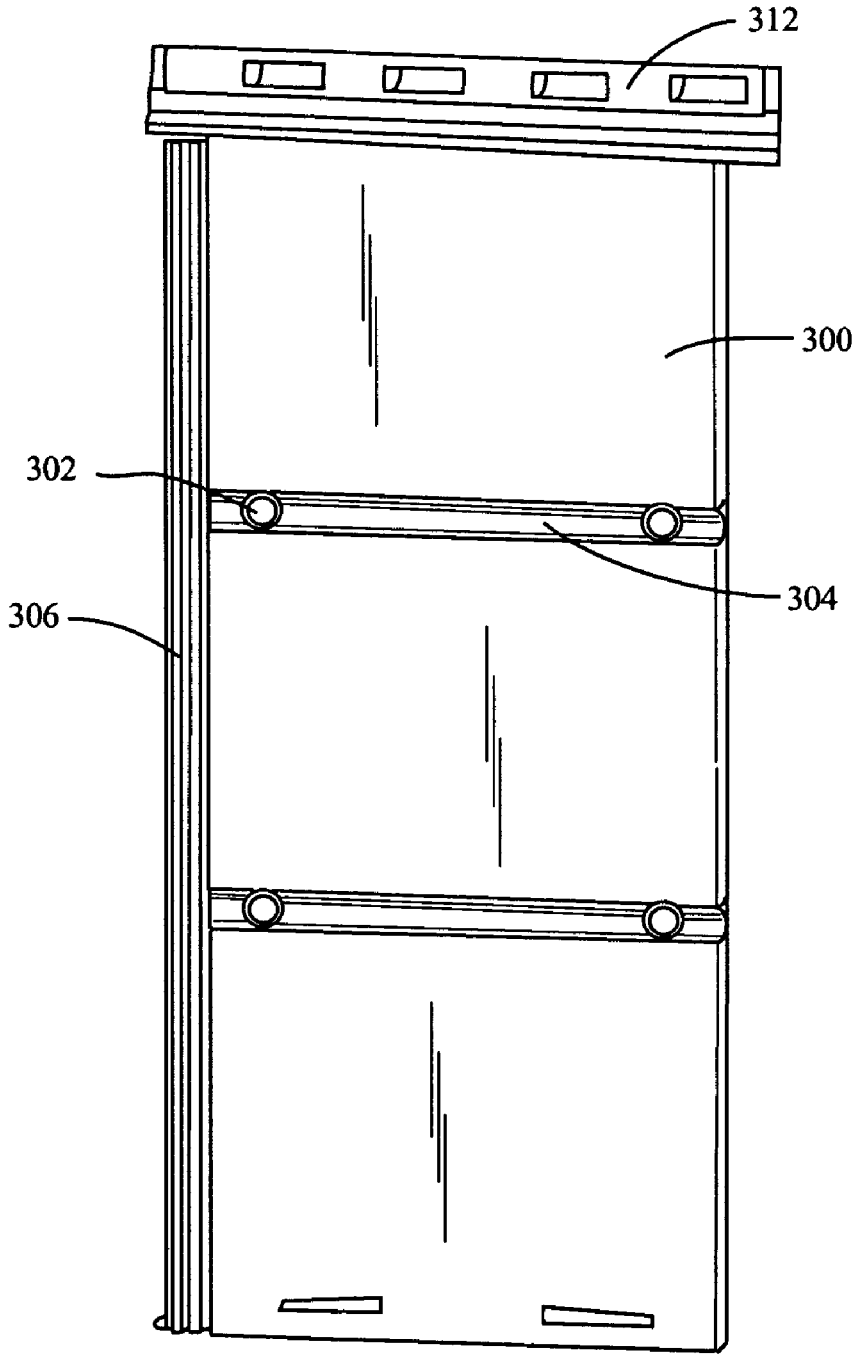
FIG. 18 is a diagram illustrating a door panel in accordance with yet another embodiment.
Figure 19:
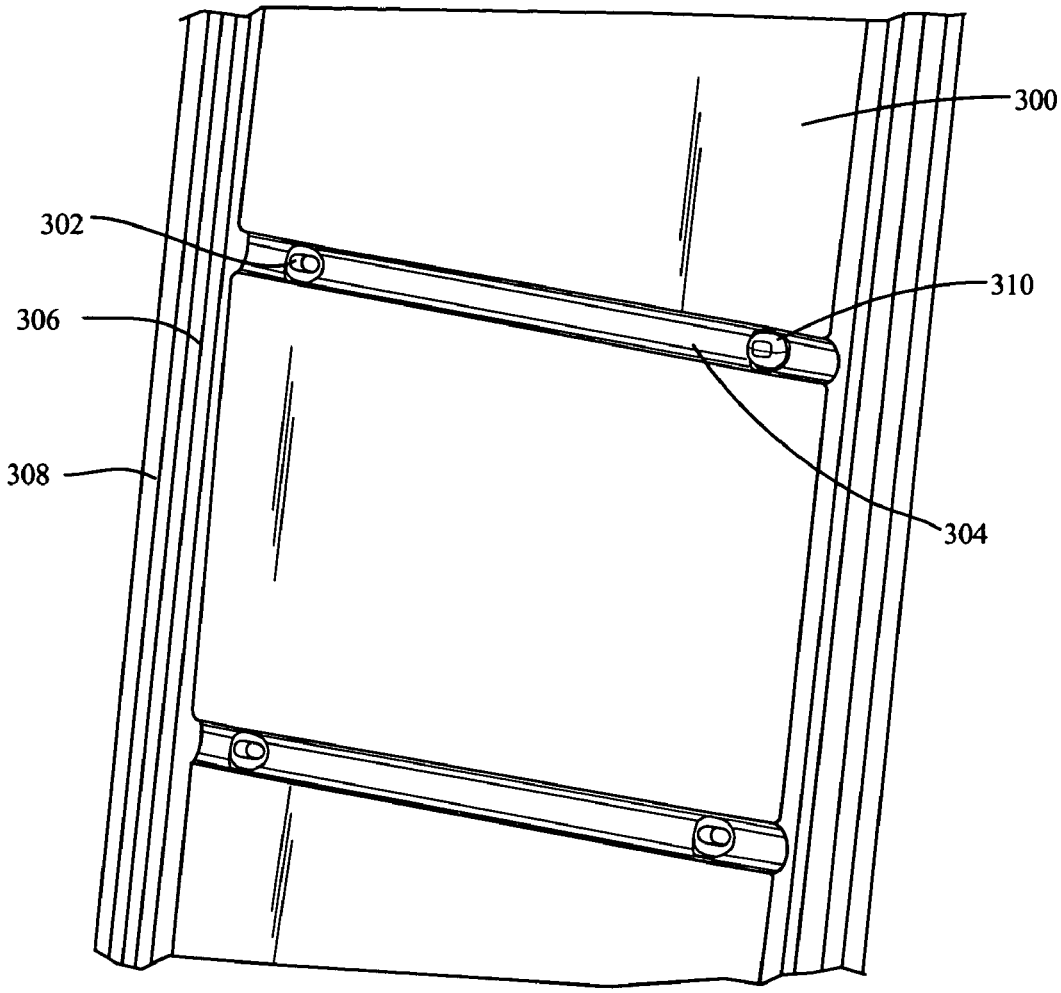
FIG. 19 is an isometric diagram illustrating part of the door panel of FIG. 18.

Referring to FIG. 18 a diagram is shown illustrating a door panel in accordance with yet another embodiment. Shown is a door panel 300, a plurality of fastener holes 302, a convolution 304, a side convolution 306, and a rod 312. Referring to FIG. 19 an isometric diagram is shown illustrating part of the door panel of FIG. 18. Shown is the door panel 300, the plurality of fastener holes 302, the convolution 304, the side convolution 306, a magnet 308 and a fastener 310.

Figure 20:
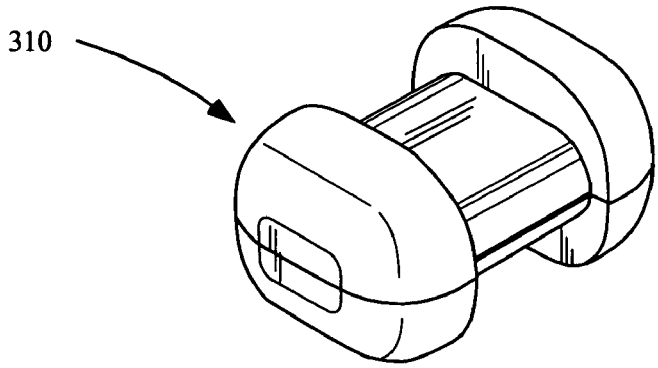
FIG. 20 is an isometric diagram illustrating a fastener of FIG. 19.

The plurality of fastener holes 302 are located in the door panel. The fastener 310 is a molded fastener that fits into one of the fastener holes 302 and securely holds the front panel 212 and the back panel 210 (as shown in FIG. 16) together. FIG. 20 illustrates one exemplary embodiment of the fastener 310. As described above, the convolutions 304 adds flexibility to the door panel. A fastener, such as is shown in FIG. 20 will fit into each of the fastener holes 302, however, only one fastener 310 is shown in FIG. 19. Alternatively, both panels are connected together by rivet type fasteners instead of the molded fasteners. It should be understood that many different types of fasteners can be used in accordance with the present embodiments.

Figure 21:
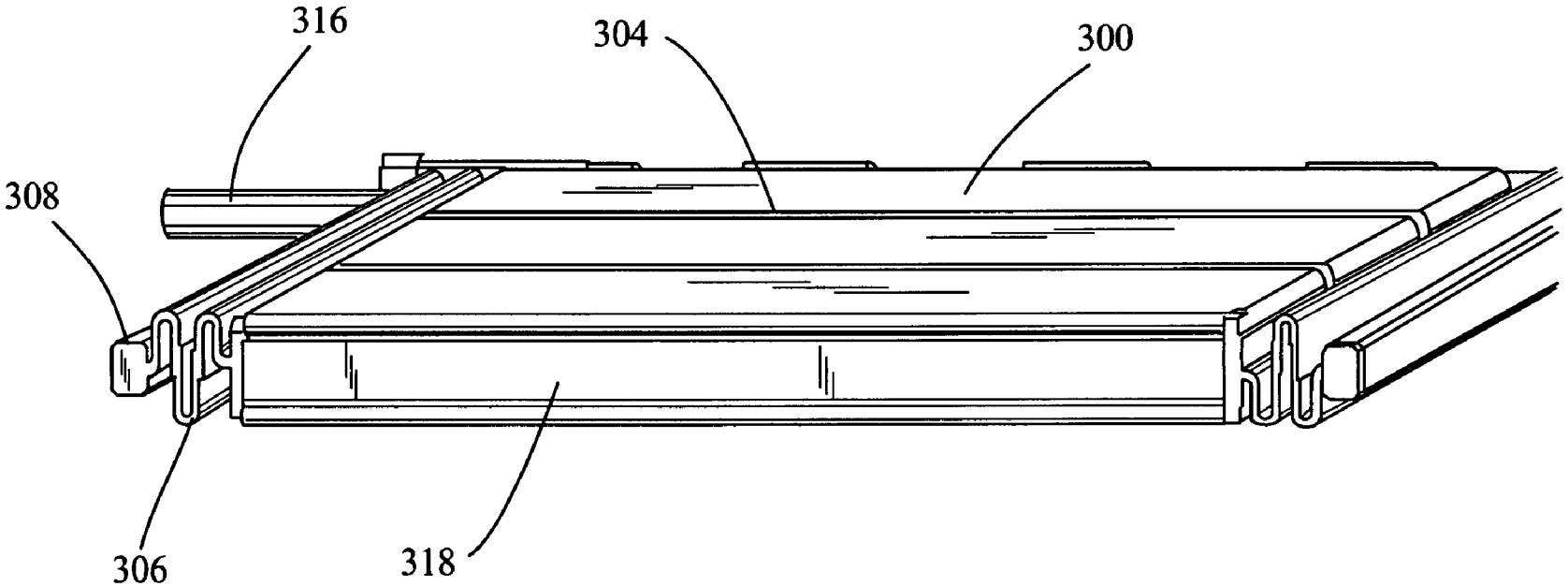
FIG. 21 is an isometric diagram illustrating a bottom view of a door panel in accordance with a preferred embodiment.

FIG. 21 is an isometric diagram illustrating a bottom view of a door panel in accordance with a preferred embodiment. Shown is the door panel 300, the convolution 304, the side convolution 306, the magnet 308, a rod 316, and a bottom retainer 318.

The side convolution 306 shown is coupled to the door panel 300. The side convolution 306 is generally sinusoidal in shape with a substantially square portion located at an end distant from the door panel 300. The magnet 308 is clipped onto the square portion of the convolution. The side convolution 306 consists of one sinusoidal component as compared to the side convolution described above with reference to FIG. 8 that has both a front portion 174 and a back portion 176. The side convolution shown operates similarly to the convolution assembly described above with reference to FIG. 8.

While the invention herein disclosed has been described by means of specific embodiments and applications thereof, other modifications, variations, and arrangements of the present invention may be made in accordance with the above teachings other than as specifically described to practice the invention within the spirit and scope defined by the following claims.

We claim:

1. A door assembly, comprising:

a door panel comprising a central portion, first and second panel edge portions, and a bottom retainer, the door panel further comprising a sealed double-walled structure for trapping an insulation;

a door frame coupled to the door panel and sized to form an aperture within which the door panel is displaceable between open and closed positions, the door frame comprising first and second frame edge portions, a bottom frame, and a bottom strike which individually cooperate with a respective one of the first and second panel edge portions and the bottom retainer of the door panel to provide a magnetic coupling when the door panel is in the closed position, the door frame further comprising a sealed doubled-walled structure for trapping an insulation, the bottom frame having a first hook, the bottom strike having a second hook; and at least one coupler being retractable toward at least one respective side frame, wherein at least one of the at least one coupler, the door panel, or the door frame comprises a magnetic feature, and wherein travel of the at least one coupler is limited by a cooperation between the first hook and the second hook.

2. The door assembly according to claim 1, wherein the at least one coupler comprises a first laterally displaceable coupler formed in the first frame edge portion and a second laterally displaceable coupler formed in the second frame edge portion.

3. The door assembly according to claim 1, wherein the at least one coupler comprises a first coupler formed in the first panel edge portion and a second coupler formed in the second panel edge portion.

4. The door assembly according to claim 3, wherein each of the first and second panel edge portions of the door panel comprises a flexible material.

5. The door assembly according to claim 3, wherein each of the first and second panel edge portions of the door panel is outwardly displaceable relative to the central portion.

6. The door assembly according to claim 3, wherein each of the first and second panel edge portions is configured to outwardly extend relative to the central portion as the door panel is positioned in the closed position.

7. The door assembly according to claim 3, wherein each of the first and second panel edge portions is configured to inwardly retract relative to the central portion as the door panel is moved from the closed position.

8. The door assembly according to claim 3, wherein the first coupler is displaceable independent of the displacement of the second coupler.

9. The door assembly according to claim 3, wherein each of the first and second panel edge portions is structured as a flexible structure having a convoluted configuration and being displaceable by the magnetic force.

10. The door assembly according to claim 3, wherein the magnetic feature comprises at least one magnet formed in relation to each of the first and second panel edge portions of the door panel.

11. The door assembly according to claim 3, wherein the magnetic feature comprises at least one magnet formed in relation to each of the first and second frame edge portions of the door frame.

12. The door assembly according to claim 3, wherein the door panel further comprises a bottom panel edge portion, wherein the door assembly further comprises a bottom strike element located on a bottom side of the door frame to magnetically cooperate with the bottom panel edge portion of the door panel, and wherein the bottom strike element is displaceably responsive to a magnetic force generated between the bottom strike element and the bottom panel edge portion.

13. The door assembly according to claim 3, wherein the magnetic feature comprises at least one magnet formed in relation to each of the first and second panel edge portions of the door panel, and wherein the magnetic feature comprises at least one magnet formed in relation to each of the first and second frame edge portions of the door frame.

14. The door assembly according to claim 3, wherein the door frame comprises a top side, a bottom side, a left side, and a right side, and wherein the door panel is coupled to the top side, the first frame edge portion is located at the left side, and the second frame edge portion is located at the right side.

15. The door assembly according to claim 1, further comprising a rod coupled to a top side of the door frame and configured to couple to the door panel to permit the displacement of the door panel between the open and closed positions.

16. The door assembly according to claim 1, wherein the door panel comprises a first portion and a second portion defining a cavity therein.

17. The door assembly according to claim 16, wherein the insulation comprises an insulating material formed in at least a portion of the cavity.

18. The door assembly according to claim 1, wherein the door panel comprises a flexible material.

19. The door assembly according to claim 1, wherein a bottom portion of the door panel is concave, and wherein a bottom portion of the door frame is convex to cooperate with the bottom portion of the door panel.

20. A door assembly, comprising:

a door panel comprising a top portion, a bottom portion, and left and right portions individually extending between the top and bottom portions, the bottom portion comprising a bottom retainer;

a first panel edge formed in at least a portion of the left portion of the door panel;

a second panel edge formed in at least a portion of the right portion of the door panel;

a door frame coupled to the top portion of the door panel and sized to form an aperture within which the door panel is displaceable between open and closed positions, the door frame comprising first and second frame edge portions, a bottom frame, and a bottom strike which individually cooperate with a respective one of the first and second panel edges and the bottom retainer of the door panel to provide a magnetic coupling when the door panel is in the closed position, the door frame further comprising a sealed doubled-walled structure for trapping an insulation, the bottom frame having a first hook, the bottom strike having a second hook; and at least one coupler being retractable toward at least one respective side frame, wherein at least one of the at least one coupler, the door panel, or the door frame comprises a magnetic feature, and wherein travel of the at least one coupler is limited by a cooperation between the first hook and the second hook.

21. The door assembly according to claim 20, wherein the at least one coupler comprises a first coupler formed in the first frame edge portion and a second coupler formed in the second frame edge portion.

22. The door assembly according to claim 20, wherein the at least one coupler comprises a first coupler formed in the first panel edge and a second coupler formed in the second panel edge.

23. The door assembly according to claim 22, wherein each of the first and second panel edges of the door panel is outwardly displaceable relative to a central portion of the door panel.

24. The door assembly according to claim 20, wherein the door panel further comprises a bottom panel edge portion, wherein the door assembly further comprises a bottom strike element located on a bottom side of the door frame to magnetically cooperate with the bottom panel edge portion of the door panel, and wherein the bottom strike element is displaceably responsive to a magnetic force generated between the bottom strike element and the bottom panel edge portion.

25. The door assembly according to claim 20, wherein the door panel comprises a flexible material.

26. A door assembly, comprising:

a door panel comprising a central portion, first and second panel edge portions, and a bottom retainer, the door anel further comprising a sealed double-walled structure for trapping an insulation;

a door frame coupled to the door panel and sized to form an aperture within which the door panel is displaceable between open and closed positions, the door frame comprising first and second frame edge portions, a bottom frame, and a bottom strike which individually cooperate with a respective one of the first and second panel edge portions and the bottom retainer of the door panel to provide a magnetic coupling when the door panel is in the closed position, the door frame further comprising a sealed doubled-walled structure for trapping an insulation, the bottom frame having a first hook, the bottom strike having a second hook; and at least one means for retracting at least one coupler toward at least one respective side frame, wherein at least one of the at least one coupler, the door panel, or the door frame comprises a magnetic feature, and wherein travel of the at least one coupler is limited by a cooperation between the first hook and the second hook.

* * * * *